US011007793B2

(12) United States Patent
Goetz

(10) Patent No.: US 11,007,793 B2
(45) **Date of Patent: *May 18, 2021**

(54) METHODS AND SYSTEMS FOR OPERATING A PRINTER APPARATUS

(71) Applicant: Datamax-O'Neil Corporation, Altamonte Springs, FL (US)

(72) Inventor: Slawek Goetz, Lake Forest, CA (US)

(73) Assignee: Datamax-O'Neil Corporation, Altamonte Springs, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/923,277

(22) Filed: Jul. 8, 2020

(65) Prior Publication Data

US 2020/0338903 A1 Oct. 29, 2020

Related U.S. Application Data

(63) Continuation of application No. 16/798,698, filed on Feb. 24, 2020, now Pat. No. 10,730,315, which is a (Continued)

(51) Int. Cl.
*B41J 2/355* (2006.01)
*B41J 2/045* (2006.01)

(52) U.S. Cl.
CPC ..... *B41J 2/3555* (2013.01); *B41J 2/0458* (2013.01); *B41J 2/04513* (2013.01); *B41J 2/04515* (2013.01); *B41J 2/04536* (2013.01)

(58) Field of Classification Search
CPC .... B41J 2/3555; B41J 2/0458; B41J 2/04515; B41J 2/04513; B41J 2/04536
See application file for complete search history.

(56) References Cited

U.S. PATENT DOCUMENTS 4,453,166 A 6/1984 Enoto
4,595,935 A 6/1986 Brooks et al.
(Continued)

OTHER PUBLICATIONS

U.S. Appl. No. 16/798,698, filed Feb. 24, 2020, U.S. Pat. No. 10,730,315, Patented.
(Continued)

*Primary Examiner* — Huan H Tran
(74) *Attorney, Agent, or Firm* — Alston & Bird LLP

(57) ABSTRACT

Various embodiments disclose a method for operating a printer apparatus. The method comprising monitoring a utilization rate of each heating element in a first set of heating elements defined by a print head arrangement. Further, the method comprises generating a utilization dataset based upon monitoring of the utilization rate of each heating element in the first set of heating elements print head arrangement. Furthermore, the method includes analyzing the utilization dataset to identify one or more overutilized heating elements of the first set of heating elements. Additionally, the method includes identifying a second set of heating elements defined by the print head arrangement. The second set of heating elements comprises a portion of the first set of heating elements exclusive of the one or more overutilized heating elements. The method further includes processing a print job. The processed print job utilized the second set of heating elements during printing.

20 Claims, 15 Drawing Sheets

Related U.S. Application Data continuation of application No. 15/947,351, filed on Apr. 6, 2018, now Pat. No. 10,596,827.

(56) References Cited

U.S. PATENT DOCUMENTS

| | | | | |
|---|---|---|---|---|
| 4,625,216 | A | 11/1986 | Brooks et al. | |
| 4,870,428 | A | 9/1989 | Kuwabara et al. | |
| 6,106,088 | A | 8/2000 | Wafler | |
| 6,158,835 | A | 12/2000 | Jackson et al. | |
| 7,717,534 | B2 | 5/2010 | Inaba et al. | |
| 9,296,214 | B2 | 3/2016 | Hunsberger, Jr. | |
| 9,579,885 | B2 | 2/2017 | Anderson et al. | |
| 10,596,827 | B2 * | 3/2020 | Goetz | B41J 2/3555 |
| 2002/0113831 | A1 | 8/2002 | Su et al. | |
| 2003/0025746 | A1 | 2/2003 | Vega | |
| 2003/0081024 | A1 | 5/2003 | Vives et al. | |
| 2005/0052483 | A1 | 3/2005 | Esaki et al. | |
| 2017/0036441 | A1 | 2/2017 | Holstun et al. | |
| 2018/0141331 | A1 | 5/2018 | Takata | |
| 2019/0308419 | A1 * | 10/2019 | Goetz | B41J 2/0458 |

OTHER PUBLICATIONS

U.S. Appl. No. 15/947,351, filed Apr. 6, 2018, U.S. Pat. No. 10,596,827, Patented.
Communication pursuant to Rules 70(2) and 70a(2) dated Oct. 14, 2019, 2 pages.
Corrected Notice of Allowability dated May 29, 2020 for U.S. Appl. No. 16/798,698.
Extended European Search Report for Application No. 19166401.0, dated Sep. 5, 2019, 9 pages.
Non-Final Rejection dated May 30, 2019 for U.S. Appl. No. 15/947,351.
Notice of Allowance and Fees Due (PTOL-85) dated Mar. 25, 2020 for U.S. Appl. No. 16/798,698.
Notice of Allowance and Fees Due (PTOL-85) dated Nov. 14, 2019 for U.S. Appl. No. 15/947,351.
Requirement for Restriction/Election dated Dec. 18, 2018 for U.S. Appl. No. 15/947,351.
Annex to the communication dated Nov. 17, 2020 for EP Application No. 19166401.0, 5 pages.
Communication from the Examining Division dated Nov. 17, 2020 for EP Application No. 19166401.0, 2 pages.

* cited by examiner

METHODS AND SYSTEMS FOR OPERATING A PRINTER APPARATUS

CROSS-REFERENCE TO RELATED APPLICATIONS

The present application is a continuation application of U.S. patent application Ser. No. 16/798,698, filed Feb. 24, 2020, which is a continuation application of U.S. patent application Ser. No. 15/947,351, filed Apr. 6, 2018, and subsequently issued as U.S. Pat. No. 10,596,827 on Mar. 24, 2020, each of which is hereby incorporated by reference in its entirety.

TECHNOLOGICAL FIELD

Example embodiments of the present disclosure relate generally to printers and, more particularly, to methods and systems for operating a printer apparatus.

BACKGROUND

Traditionally, a printer may correspond to a peripheral device that is configured to reproduce graphics and/or text on a print medium. Some examples of the printer may include, but are not limited to, a toner-based printer, a laser printer, an ink-jet printer, a thermal printer, and/or the like. A typical thermal printer may include a print head arrangement that may include a plurality of heating elements. These heating elements may be heated and pressed against a ribbon or thermal paper to perform a print operation. Traditionally, each of the heating elements in the print head arrangement may have a predetermined life that is deterministic of a life of the print head arrangement as a whole. That is, the life of the print head arrangement is defined, in some examples, by the heating element having the shortest life. For example, the print head arrangement of the thermal printer may fail due to failure of a set of heating elements of the plurality of heating elements.

Applicant has identified a number of deficiencies and problems associated with conventional printer apparatuses and other associated systems and methods. Through applied effort, ingenuity, and innovation, many of these identified problems have been solved by developing solutions that are included in embodiments of the present disclosure, many examples of which are described in detail herein.

BRIEF SUMMARY

In accordance with various illustrated embodiments, a method for operating a printer apparatus is illustrated. The method includes monitoring a utilization rate of each heating element in a first set of heating elements defined by a print head arrangement. Further, the method comprises generating a utilization dataset based upon monitoring of the utilization rate of each heating element in the first set of heating elements print head arrangement. The method includes analyzing the utilization dataset to identify one or more overutilized heating elements of the first set of heating elements. Additionally, the method includes identifying, by the heating element identification unit, a second set of heating elements defined by the print head arrangement. The second set of heating elements includes a portion of the first set of heating elements exclusive of the one or more overutilized heating elements. The method includes processing, by a controller, a print job, wherein printing the processed print job includes utilizing the second set of heating elements such that an energization of the overutilized heating elements is minimized.

In accordance with various illustrated embodiments, a printer apparatus is illustrated. The printer apparatus includes a print head arrangement comprising a first set of heating elements. Further, the printer apparatus includes a controller coupled to the print head arrangement. The controller is configured to monitor a utilization rate of each heating element in the first set of heating elements defined by the print head arrangement. Further, the controller is configured to generate a utilization dataset based upon the monitoring of the utilization rate of each heating element in the first set of heating elements. Furthermore, the controller is configured to analyze the utilization dataset to identify one or more overutilized heating elements of the first set of heating elements. Additionally, the controller is configured to identify a second set of heating elements defined by the print head arrangement. The second set of heating elements comprises a portion of the first set of heating elements exclusive of the one or more overutilized heating elements. Further, the controller is configured to process a print job to determine a processed print job, wherein printing of the processed print job includes utilizing the second set of heating elements such that an energization of the overutilized heating elements is minimized.

In accordance with various illustrated embodiments, a computer program product comprising at least one non-transitory computer-readable storage medium having computer-executable program code instruction stored therein, is illustrated. The computer-executable program code instructions comprising program code instructions for monitoring a utilization rate of each heating element in a first set of heating elements defined by a print head arrangement. Further, the computer-executable program code instructions comprise the program code instructions for generating a utilization dataset based upon monitoring of the utilization rate of each heating element in the first set of heating elements print head arrangement. Furthermore, the computer-executable program code instructions comprise the program code instructions for analyzing the utilization dataset to identify one or more overutilized heating elements of the first set of heating elements. Additionally, the computer-executable program code instructions comprise the program code instructions for identifying a second set of heating elements defined by the print head arrangement, wherein the second set of heating elements comprises a portion of the first set of heating elements exclusive of the one or more overutilized heating elements. The computer-executable program code instructions further comprise the program code instructions for processing a print job to determine a processed print job, wherein printing of the processed print job includes utilizing the second set of heating elements such that an energization of the overutilized heating elements is minimized.

The above summary is provided merely for purposes of summarizing some exemplary embodiments to provide a basic understanding of some aspects of the disclosure. Accordingly, it will be appreciated that the above-described embodiments are merely examples and should not be construed to narrow the scope or spirit of the disclosure in any way. It will be appreciated that the scope of the disclosure encompasses many potential embodiments in addition to those here summarized, some of which are further explained within the following detailed description and its accompanying drawings.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1:
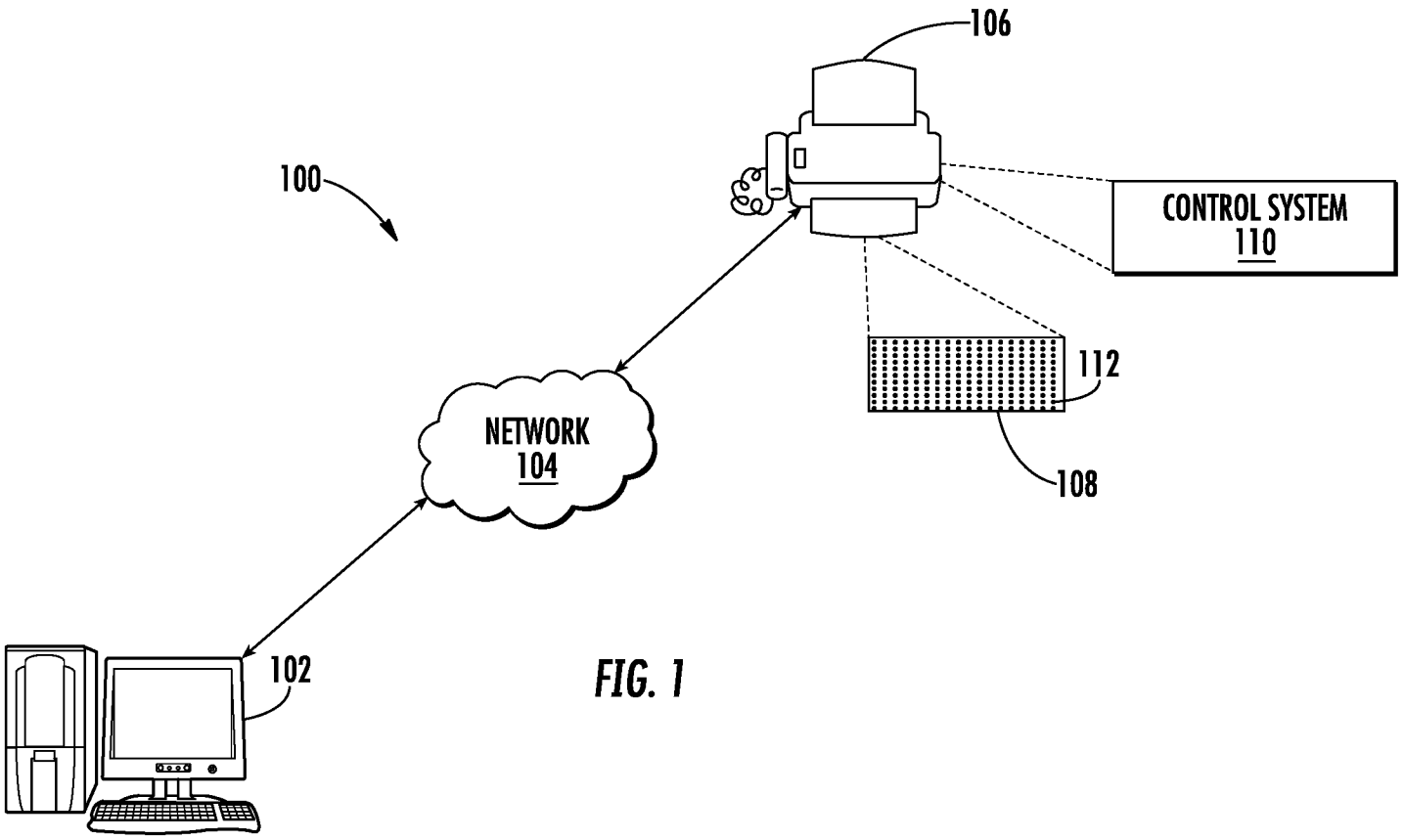
FIG. 1 illustrates a system environment where various embodiments of the disclosure may be implemented, in accordance with one or more embodiments of the present disclosure.

Some embodiments of the present disclosure will now be described more fully hereinafter with reference to the accompanying drawings, in which some, but not all embodiments of the disclosure are shown. Indeed, these disclosures may be embodied in many different forms and should not be construed as limited to the embodiments set forth herein; rather, these embodiments are provided so that this disclosure will satisfy applicable legal requirements. Like numbers refer to like elements throughout. Terminology used in this patent is not meant to be limiting insofar as devices described herein, or portions thereof, may be attached or utilized in other orientations The term "comprising" means including but not limited to, and should be interpreted in the manner it is typically used in the patent context. Use of broader terms such as comprises, includes, and having should be understood to provide support for narrower terms such as consisting of, consisting essentially of, and comprised substantially of The phrases "in one embodiment," "according to one embodiment," and the like generally mean that the particular feature, structure, or characteristic following the phrase may be included in at least one embodiment of the present disclosure, and may be included in more than one embodiment of the present disclosure (importantly, such phrases do not necessarily refer to the same embodiment)

The word "exemplary" is used herein to mean "serving as an example, instance, or illustration." Any implementation described herein as "exemplary" is not necessarily to be construed as preferred or advantageous over other implementations.

If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

In a thermal printer, the life of a print head arrangement may be determined based on, in some examples, a life of a first set of heating elements in the print head arrangement. If one or more heating elements in the print head arrangement fails, due to overutilization, the print head arrangement as a whole may not be utilizable to process future print jobs. In certain scenarios, an operator of the thermal printer may be unaware of an imminent failure of the print head arrangement, due to a lack of availability of data pertaining to utilization of the print head arrangement. Such sudden and uninformed failure of the print head arrangement may lead to a loss in productivity and efficiency.

Example embodiments described herein provide methods, apparatuses, and systems that may facilitate monitoring of a utilization rate of a first set of heating elements in a print head arrangement. In an example embodiment, the monitoring of the utilization rate of the first set of heating elements includes determining an energization count for each heating element in the first set of heating elements. In an example embodiment, the energization count may include the number of times each heating element in the first set of heating elements is energized to process a print job. Further, the monitoring may, in some embodiments, determine an energization duration for each heating element in the first set of heating elements during the processing of the print job.

The energization count and the energization duration for each heating element in the first set of heating elements may be storable in a memory, locally and/or remotely, and as a utilization dataset. Thereafter, the utilization dataset may be analyzed to identify the presence of one or more overutilized heating elements in the first set of heating elements. Said differently, the embodiments described herein may analyze the utilization dataset to predict a shortened life of the print head arrangement based upon identified overutilized heating elements.

In response to the identification of the one or more overutilized heating elements, a notification may be generated that informs one or more users of possible failure of the print head. In an example embodiment, the notification may include a histogram depicting the utilization of each heating element in the first set of heating elements. Further, the notification may include information pertaining to a life of each heating element of the first set of heating elements determined based on analysis of the utilization dataset. For example, the life of each heating element of the plurality of heating elements may be determined based on the energization count associated with each heating element in the first set of heating elements and/or based upon the energization duration associated with each heating element in the first set of heating elements.

The generation of a notification may allow an operator of the thermal printer to proactively adjust the thermal printer or print hob such that the productivity and/or the efficiency of the process (in which the thermal printer is being used) is not compromised. By way of example, the operator of the thermal printer may, in response to a notification, proactively replace the print head arrangement of the thermal printer or take other such steps to extend the life of the thermal printer.

Alternatively or additionally, in response to the identification of the one or more overutilized heating elements, a second set of heating elements in the print head may be identified. In some example embodiments, the second set of heating elements includes a portion of the first set of heating elements. For example, the second set of heating elements may include heating elements that are underutilized in comparison to the utilization of the one or more overutilized heating elements described above. Further, a print job (e.g., a pending request to print content by the thermal printer) may processed to determine a processed print job such that at least the second set of heating elements are energized during printing of the processed print job. In some example embodiments, the processing of the print job may include modifying the print job (e.g., currently or previously performed by the thermal printer) to generate modified print job (e.g., the processed print job). Printing the modified print job (e.g., processed print job) may utilize the second set of heating elements such that the overutilization of the one or more overutilized heating elements minimized. For example, position of data in the print job, may be modified such that only a portion of the second set of heating elements will be energized during the printing of the modified print job. Alternately, the print job may be modified such that the second set of heating elements and a portion of the one or more overutilized heating elements are utilized to print the print job.

Such modification of the print job to minimize the overutilization of the one or more overutilized heating elements may function to extend the life of the print head arrangement; therefore, providing improved cost savings. Having described example embodiments of the present disclosure generally, particular features and functionality of the various devices are hereinafter described.

With reference to FIG. 1 a system environment 100 where various embodiments of the disclosure may be implemented is shown. The system environment includes a computing device 102, a network 104, and a printer apparatus 106. Further, the printer apparatus 106 includes a print head arrangement 108 and a control system 110. The computing device 102 and the printer apparatus 106 may be communicatively coupled with each other through the network 104.

The computing device 102 may include one or more processors and one or more memories. The one or more memories may include computer readable code that may be executable by the one or more processors to perform predetermined operation. For example, the one or more processors may be configured to execute the computer readable code to generate a print job and determine a processed print job. In an example embodiment, the print job may include data to be printed by the printer apparatus 106. Some examples of the data may include text and/or graphics. Further, the print job may define the location in which the data is to be printed on a print medium (e.g., a position). For example, the print job may include coordinates of the text, which define the position of the text on the print medium, when printed. In an example embodiment, the print job is created by a driver software installed on the computing device 102. In an example embodiment, the driver software includes a set of computer readable code that allows the computing device 102 to create the print job, modify the print job, process the print job and/or determine a processed print job. In some embodiments, the driver software may be specifically configured for use with the related printer and may include printer data including printer specifications. For example, the driver software may include details pertaining to the heating elements in the print head arrangement 108 (e.g., type, configuration, size, or the like). The computing device 102 may, for example, generate the print job in accordance to the data pertaining to the heating elements included in the driver software. After the generation of the print job, the computing device 102 may be further configured to transmit the print job to the printer apparatus 106 through the network 104. The operation and structure of the computing device 102 has been further described in conjunction with FIGS. 12, 13, 14, and 15. Some examples of the computing device 102 may include a desktop computer, a laptop, a tablet computer, a mobile phone, or any other computing device that may be capable of generating and transmitting the print job.

The network 104 as illustrated refers to any medium through which content and messages may flow between various devices in the system environment 100 (e.g., the computing device 102 and the printer apparatus 106). Examples of the network 104 may include, but are not limited to, a Wireless Fidelity (Wi-Fi) network, a Wireless Area Network (WAN), a Local Area Network (LAN), or a Metropolitan Area Network (MAN). Various devices in the system environment 100 may connect to the network 104 in accordance with various wired and wireless communication protocols such as Transmission Control Protocol and Internet Protocol (TCP/IP), User Datagram Protocol (UDP), and 2G, 3G, or 4G communication protocols.

The printer apparatus 106 may refer to a peripheral device that is capable for reproducing text and graphics on a print medium. Said differently, the printer apparatus 106 may be configured to perform a print operation associated with the print job provided by the computing device 102. In an example embodiment, the print head arrangement 108 in the printer apparatus 106 may be configured to perform the print operation. Some examples of the printer apparatus 106 may include, but are not limited to, an ink-jet printer, a laser printer, and a thermal printer. For the purpose of ongoing description, the printer apparatus 106 is described with reference to a thermal printer. However, the present disclosure contemplates that the embodiments described herein may be equally applicable to other types of printer apparatuses without departing from the scope of the disclosure.

The print head arrangement 108 may refer to a component of the printer apparatus 106 that is configured to print data on a print medium. In an example embodiment, the print head arrangement 108 may include a first set of heating elements 112 that is energized (hereinafter interchangeably referred to as heated) and pressed against a ribbon or other print medium, such as a thermal paper, to perform a print operation. In an example embodiment, during the print operation, only one or more heating elements in the first set of heating elements are energized to perform the print operation. The one or more heating elements may be selected by the control system 110 based on the position of the data defined in the print job. To energize the one or more heating elements, a voltage signal is applied across the one or more heating elements, causing the heating elements to heat up. In an example embodiment, the heating of the one or more heating elements corresponds to the energization of the one or more heating elements. In an embodiment, the print head arrangement may include one or more switches (implemented using one or more relays or transistors) through which the voltage is applied across the one or more heating elements.

The control system 110 may be configured to control the operation of various components of the printer apparatus 106. For example, the control system 110 may be configured to control the operation of the print head arrangement 108. In an example embodiment, the control system 110 may be further configured to monitor and record a utilization rate of the first set of heating elements 112, of the print head arrangement 108, during a print operation (as described below with reference to FIG. 3). For example, the control system 110 may be configured to monitor and record an energization count and an energization duration for each heating element in the first set of heating elements 112, during the printing of the one or more print jobs (hereinafter interchangeably referred to as previous print jobs). In an example embodiment, the energization count may define a number of times each heating element of the first set of heating elements is energized during printing of one or more previous print jobs. In an example embodiment, the energization duration may define a time period during which each heating element in the first set of heating elements is energized during printing of the one or more previous print jobs.

While description herein is provided with reference to the energization count and the energization duration as one or more monitored parameters of the first heating elements 112 used to determine utilization, the present disclosure contemplates that additional parameters may alternatively or additionally be considered. In some embodiments, the one or more parameters may further include information pertaining to a position of each heating element (in the first set of heating elements) of the print head arrangement 108, without deviation from the scope of the present disclosure. In an example embodiment, the position of a heating element may correspond to a coordinate of the heating element on the print head arrangement 108. By way of specific example, the heating element may be positioned at the coordinate (x1, y1) on the print head arrangement 108. Further, based on the monitoring of the one or more parameters (e.g., energization count and/or energization duration), the control system 110 may be configured to generate a utilization dataset pertaining to the utilization of the heating element, positioned at the coordinate (x1, y1), of the first set of heating elements 112. Based on the utilization dataset, the control system 110 may be configured to identify one or more overutilized heating elements, such as the heating element described above that is positioned at the coordinate (x1, y1), of the first set of heating elements 112. Further, the control system 110 may be configured to modify the print job based on the identification of the one or more overutilized heating elements. The structure of the control system 110 has been described hereafter in conjunction with FIG. 2.

Figure 2:
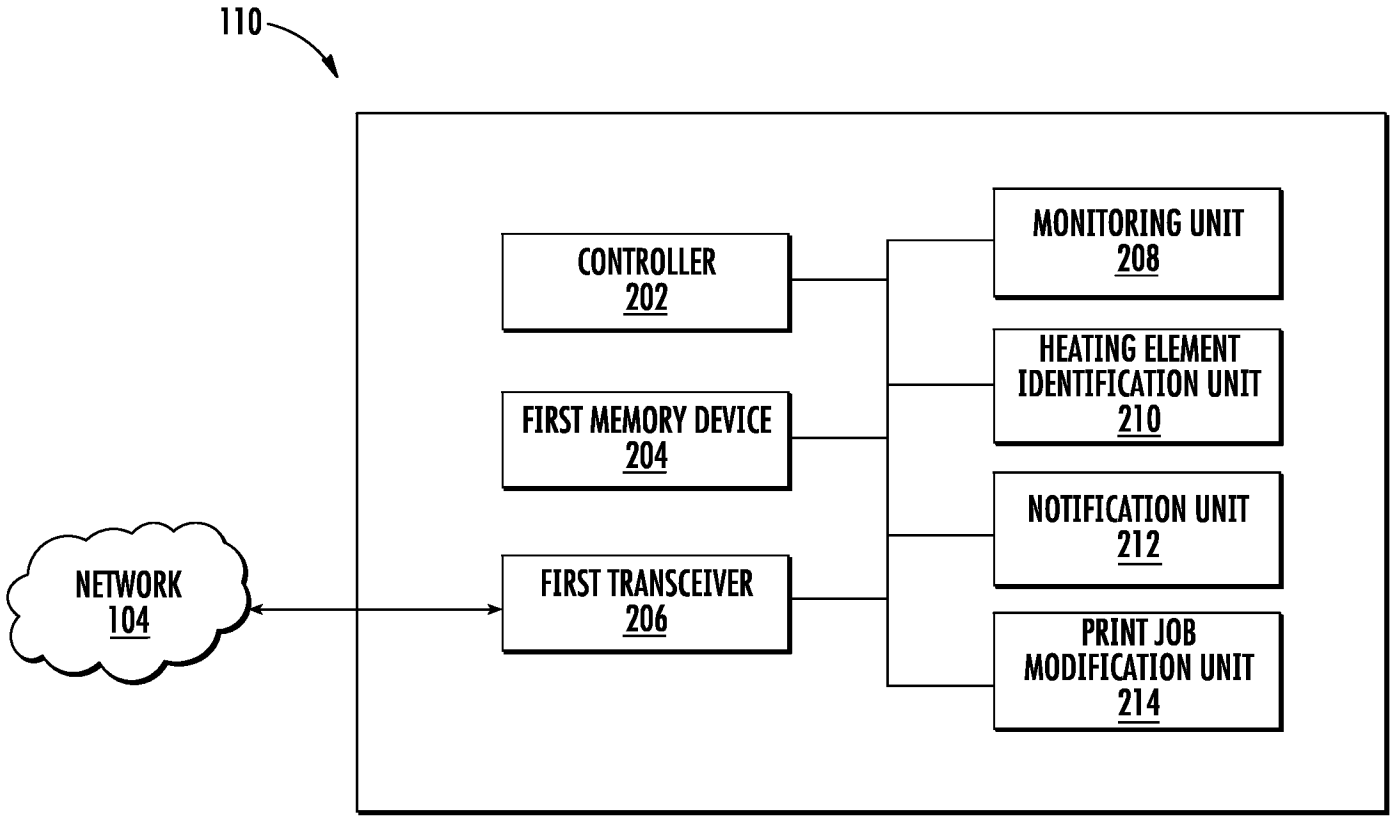
FIG. 2 illustrates the block diagram of a control system, in accordance with the one or more embodiments of the present disclosure.

With reference to FIG. 2 a block diagram of the control system 110, in accordance with the one or more embodiments of the present disclosure is illustrated.

In some embodiments, the control system 110 may include a controller 202, a first memory device 204, a first communications interface first communication interface 206, a monitoring unit 208, a heating element identification unit 210, a notification unit 212, and a print job modification unit 214. Each of the first memory device 204, the first communication interface 206, the monitoring unit 208, the heating element identification unit 210, the notification unit 212, and the print job modification unit 214 may be communicatively coupled to the controller 202.

The controller 202 may include one or more microprocessors with accompanying digital signal processor(s), one or more processor(s) without an accompanying digital signal processor, one or more coprocessors, one or more multi-core processors, one or more controllers, processing circuitry, one or more computers, various other processing elements including integrated circuits such as, for example, an application specific integrated circuit (ASIC) or field programmable gate array (FPGA), or some combination thereof. Accordingly, although illustrated in FIG. 2 as a single controller, in an example embodiment, the controller 202 may include a plurality of processors and signal processing modules. The plurality of processors may be embodied on a single electronic device or may be distributed across a plurality of electronic devices collectively configured to function as the circuitry of the control system 110. The plurality of processors may be in operative communication with each other and may be collectively configured to perform one or more functionalities of the circuitry of the control system 110, as described herein. In an example embodiment, the controller 202 may be configured to execute instructions stored in the first memory device 204 or otherwise accessible to the controller 202. These instructions, when executed by the controller 202, may cause the circuitry of the control system 110 to perform one or more of the functionalities, as described herein.

Whether configured by hardware, firmware/software methods, or by a combination thereof, the controller 202 may include an entity capable of performing operations according to embodiments of the present disclosure while configured accordingly. Thus, for example, when the controller 202 is embodied as an ASIC, FPGA or the like, the controller 202 may include specifically configured hardware for conducting one or more operations described herein. Alternatively, as another example, when the controller 202 is embodied as an executor of instructions, such as may be stored in the first memory device 204, the instructions may specifically configure the controller 202 to perform one or more algorithms and operations described herein.

Thus, the controller 202 used herein may refer to a programmable microprocessor, microcomputer or multiple processor chip or chips that can be configured by software instructions (applications) to perform a variety of functions, including the functions of the various embodiments described above. In some devices, multiple processors may be provided dedicated to wireless communication functions and one processor dedicated to running other applications. Software applications may be stored in the internal memory before they are accessed and loaded into the processors. The processors may include internal memory sufficient to store the application software instructions. In many devices, the internal memory may be a volatile or nonvolatile memory, such as flash memory, or a mixture of both. The memory can also be located internal to another computing resource (e.g., enabling computer readable instructions to be downloaded over the Internet or another wired or wireless connection).

The first memory device 204 may include suitable logic, circuitry, and/or interfaces that are adapted to store a set of instructions that is executable by the controller 202 to perform predetermined operations. Some of the commonly known memory implementations include, but are not limited to, a hard disk, random access memory, cache memory, read only memory (ROM), erasable programmable read-only memory (EPROM) & electrically erasable programmable read-only memory (EEPROM), flash memory, magnetic cassettes, magnetic tape, magnetic disk storage or other magnetic storage devices, a compact disc read only memory (CD-ROM), digital versatile disc read only memory (DVD-ROM), an optical disc, circuitry configured to store information, or some combination thereof. In an example embodiment, the first memory device 204 may be integrated with the controller 202 on a single chip, without departing from the scope of the disclosure.

The first communication interface 206 may correspond to a communication interface that may facilitate transmission and reception of messages and data to and from various devices operating in the system environment 100 through the network 104. For example, the first communication interface 206 is communicatively coupled with the computing device 102 through the network 104. Examples of the first communication interface 206 may include, but are not limited to, an antenna, an Ethernet port, a USB port, a serial port, or any other port that can be adapted to receive and transmit data. The first communication interface 206 transmits and receives data and/or messages in accordance with the various communication protocols, such as, I2C, TCP/IP, UDP, and 2G, 3G, or 4G communication protocols.

The monitoring unit 208 may include suitable logic and circuitry that may allow the control system 110 to monitor a utilization rate of the first set of heating elements 112, during a print operation. As discussed, the monitoring of the utilization rate includes monitoring the one or more parameters associated with the first set of heating elements 112. For example, the monitoring unit 208 may be configured to monitor the energization count and the energization duration associated with each heating element of the first set of heating elements 112, during printing of the one or more previous print jobs as described in detail below with reference to FIG. 3. Based on the monitoring of the one or more parameters associated with the first set of heating elements 112, the monitoring unit 208 may be configured to generate the utilization dataset. In an example embodiment, the utilization dataset may include a cumulative count of times each heating element of the first set of heating elements 112 has been energized during printing of the one or more previous print jobs (hereinafter referred to as a cumulative energization count). Alternately or additionally, the utilization dataset may include a cumulative duration of energization of each heating element, in the first set of heating elements 112, during printing of the one or more previous print jobs (hereinafter referred to as a cumulative energization duration). While reference is made herein to the utilization dataset including only the cumulative energization count and the cumulative energization duration, associated with each heating element of the first set of heating elements 112, the present disclosure contemplates that additional parameters may be equally considered. In an example embodiment, the utilization dataset may further include, for each of the one or more previous print jobs, the energization count corresponding to a number of times each heating element in the first set of heating elements 112 has been energized, and the energization duration associated with each heating element in the first set of heating elements. Further, the monitoring unit 208 may be configured to store the utilization dataset in the first memory device 204. In an example embodiment, the monitoring unit 208 may be further configured to update the utilization dataset during or upon completed for each print job is printed by the printer apparatus 106. The monitoring unit 208 may be implemented using one or more technologies, such as, but not limited to, FPGA, ASIC, and the like.

The heating element identification unit 210 may include any suitable logic and/or circuitry that may enable the control system 110 to identify the one or more overutilized heating elements from the first set of heating elements 112 in the print head arrangement 108, as is further described below with reference to FIG. 3. In an example embodiment, the heating element identification unit 210 may be configured to analyze the utilization dataset (stored in the first memory device 204) to identify the one or more overutilized heating element. The heating element identification unit 210 may be further configured to determine and store the one or more parameters associated with each of the one or more overutilized heating elements in the first memory device 204. Further, based on the identification of the one or more overutilized heating elements, the heating element identification unit 210 may be configured to identify a second set of heating elements in the print head arrangement 108, as is further described in FIG. 3. In some example embodiments, the second set of heating elements may include a portion of the first set of heating elements. For example, the second set of heating elements may include heating elements (of the first set of heating elements) that are underutilized in comparison to the one or more overutilized heating elements and, in some embodiments, the second set of heating elements may be exclusive of the overutilized heating elements. The heating element identification unit 210 may be implemented using one or more technologies, such as, but not limited to, FPGA, ASIC, and the like.

The notification unit 212 may include any suitable logic and/or circuitry that may enable the control system 110 to generate a notification, in response to the identification of the one or more overutilized heating elements, as is further described with reference to FIG. 3. Further, the notification unit 212 may be configured to generate a graphical representation, such as a histogram, indicative of the utilization of each heating element of the first set of heating elements 112, based on the analysis of the utilization dataset, as is illustrated FIG. 7. In an example embodiment, the notification unit 212 may be configured to include the histogram in the notification. Additionally or alternately, the notification unit 212 may be configured to include information pertaining to a life of each heating element of the first set of heating elements 112 in the notification. In an example embodiment, the life associated with each heating element of the first set of heating elements 112 may include information pertaining to a second count of times each heating element of the first set of heating elements 112 is energizable (hereinafter referred to as second energization count) and the second duration of energization for the which each heating element of the first set of heating elements 112 is energizable (hereinafter referred to second energization duration). The determination of the life of each heating element in the first set of heating elements has been further described in conjunction with FIG. 6 below. Further, the notification unit 212 may be configured to transmit the notification to the computing unit 102. In an alternate embodiment, the notification unit 212 may be configured to display the notification on a display device (not shown) associated with the printer apparatus 106. In yet another alternate embodiment, the notification unit 212 may be configured to activate a light emitting diode (LED) on the printer apparatus 106 to indicate the notification. The notification unit 212 may be implemented using one or more technologies such as, but not limited to, FPGA, ASIC, and the like.

The print job modification unit 214 may include any suitable logic and/or circuitry that enables the control system 110 to process the print job (received from the computing device 102) such that the processed print job utilizes the second set of heating elements during printing, as is further described below with reference to FIG. 8. To process the print job, the print job modification unit 214 may be configured to determine one or more possible modifications that can be made to one or more characteristics of the data included in the print job (determine a processed print job), as is further described in FIG. 8. In an example embodiment, the one or more characteristics associated with the data may include, but are not limited to, a position of the data, a size of the data, and a font type of the data. Further, the print job modification unit 214 may be configured to generate one or more print job recommendations corresponding to the one or more possible modifications, as is further described in FIG. 8. Further, the print job modification unit 214 may be configured to display the one or more print job recommendations on the display device (not shown) of the printer apparatus 106. Alternately, the print job modification unit 214 may be configured to transmit the one or more print job recommendations to the computing device 102 through the notification unit 212. Further, the print job modification unit 214 may be configured to receive an input from the operator of the printer apparatus 106 to select a recommendation from the one or more print job recommendations, through the notification unit 212. Based on the selected recommendation, the print job modification unit 214 may be configured to modify the print job, as is further described in FIG. 8 (e.g., a processed print job). In an alternate embodiment, the print job modification unit 214 may be configured to automatically select the recommendation from the one or more print job recommendations, as is further described in FIG. 8. The print job modification unit 214 may be implemented using one or more technologies such as, but not limited to, FPGA, ASIC, and the like. In another alternate embodiment, the print job modification unit 214 may be configured to receive an input from the operator of the printer apparatus 106 that does not selected a recommendation from the one or more print job recommendations, through the notification unit 212.

In an example embodiment, the controller 202 may be configured to control the operation of the various units of the control system 110. One of ordinary skill in the art would appreciate that the scope of the disclosure is not limited to having separate units in the control system 110. In some example embodiments, each of the first memory device 204, the first communication interface 206, the monitoring unit 208, the heating element identification unit 210, the notification unit 212, and the print job modification unit 214, may be embedded in the controller 202. In such a scenario, the controller 202 may be configured to perform the operation of each unit in the control system 110. The operation of the control system 110 has been described in conjunction with FIG. 3. In some embodiments, the control system 110 may be partially or fully implemented on the computing device 102, without departing from the scope of the disclosure.

FIGS. 3-6 and 8 illustrate example flowcharts of the operations performed by an apparatus, such as printer apparatus 106 of FIG. 2 in accordance with example embodiments of the present invention. It will be understood that each block of the flowcharts, and combinations of blocks in the flowcharts, may be implemented by various means, such as hardware, firmware, one or more processors, circuitry and/or other devices associated with execution of software including one or more computer program instructions. For example, one or more of the procedures described above may be embodied by computer program instructions. In this regard, the computer program instructions which embody the procedures described above may be stored by a memory of an apparatus employing an embodiment of the present invention and executed by a processor in the apparatus. As will be appreciated, any such computer program instructions may be loaded onto a computer or other programmable apparatus (e.g., hardware) to produce a machine, such that the resulting computer or other programmable apparatus provides for implementation of the functions specified in the flowcharts' block(s). These computer program instructions may also be stored in a non-transitory computer-readable storage memory that may direct a computer or other programmable apparatus to function in a particular manner, such that the instructions stored in the computer-readable storage memory produce an article of manufacture, the execution of which implements the function specified in the flowcharts' block(s). The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowcharts' block(s). As such, the operations of FIGS. 3-6 and 8, when executed, convert a computer or processing circuitry into a particular machine configured to perform an example embodiment of the present invention. Accordingly, the operations of FIGS. 3-6 and 8 define an algorithm for configuring a computer or processor, to perform an example embodiment. In some cases, a general purpose computer may be provided with an instance of the processor which performs the algorithm of FIGS. 3-6 and 8 to transform the general purpose computer into a particular machine configured to perform an example embodiment.

Accordingly, blocks of the flowchart support combinations of means for performing the specified functions and combinations of operations for performing the specified functions. It will also be understood that one or more blocks of the flowcharts', and combinations of blocks in the flowchart, can be implemented by special purpose hardware-based computer systems which perform the specified functions, or combinations of special purpose hardware and computer instructions.

Figure 3:
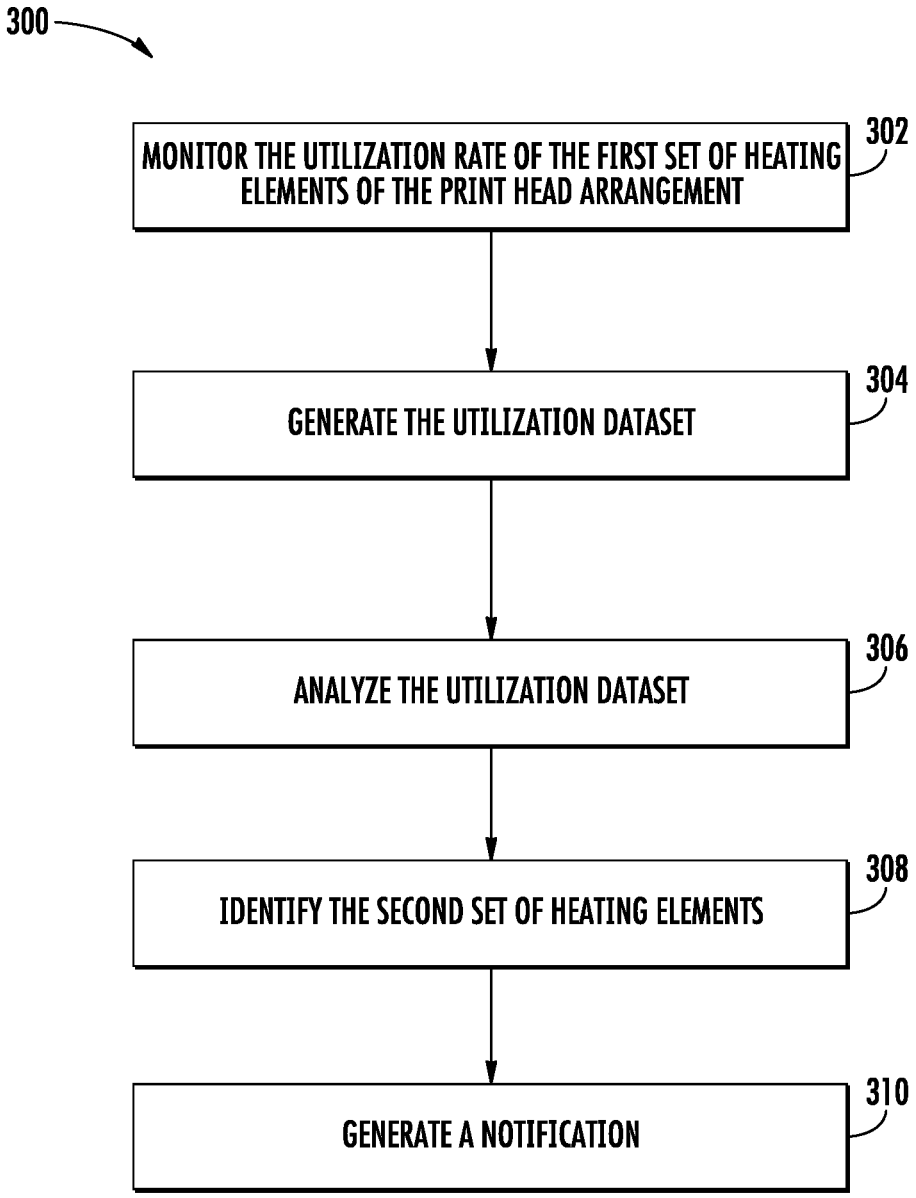
FIG. 3 illustrates a flowchart of a method for operating a printer apparatus, in accordance with one or more embodiments of the present disclosure.

FIG. 3 illustrates a flowchart 300 depicting a method for operating the printer apparatus 106, in accordance with one or more embodiments of the present disclosure.

At step 302, the printer apparatus 106 may include means, such as the control system 110, the monitoring unit 208, or the like for monitoring the utilization rate of the first set of heating elements 112 during the printing of the one or more previous print jobs. As discussed above, the monitoring of the utilization rate includes monitoring of the one or more parameters associated with the first set of heating elements. Therefore, during the printing of the previous print jobs, the monitoring unit 208 may be configured to monitor the one or more parameters associated with the first set of heating elements 112. For example, the monitoring unit 208 may be configured to monitor the energization count corresponding to the number of times each heating element of the first set of heating elements 112 has been energized, during printing of each of the previous print jobs. In another example, the monitoring unit 208 may be further configured to monitor the energization duration of each heating element of the first set of heating elements 112 in the print head arrangement 108, during the printing of the previous print jobs. The energization duration associated with each heating element in the first set of heating elements may correspond to a time period for which a heating element has been energized during the printing of a print job. For example, during the printing of a previous print job, the monitoring unit 208 may determine that a heating element of the first set of heating elements 112 has been energized twice, the first for "0.1" seconds to print a first character and the second for "0.2" seconds to print a second character. Therefore, in such an example, the monitoring unit 208 may determine that the energization count associated with the heating element is "2", and the energization duration associated with the heating element is "0.3" seconds.

In an example embodiment, to determine the energization count, the monitoring unit 208 may be configured to determine a count of times a voltage signal has been applied to a specific heating element. The count of the number of times the voltage signal is applied to the heating element may correspond to the energization count associated with the heating element. Similarly, the monitoring unit 208 may be configured to determine a duration for which the voltage signal is applied on the heating element. The duration of the voltage signal may correspond to the energization duration associated with the heating element. In some embodiments, the duration for each instance in which a voltage signal is applied to a heating element may be consistent between individual heating elements (e.g., each voltage signal is applied to each heating element for the same duration). In such an embodiment, the energization count between heating elements may be uniformly compared.

Similarly, the monitoring unit 208 may monitor the energization count and the energization duration for other heating elements in the first set of heating elements 112. Further, the monitoring unit 208 may be configured to determine the cumulative energization count for each heating element in the first set of heating elements 112, and the cumulative energization duration for each heating element in the first set of heating elements 112, based on the energization count and the energization duration determined during the printing of the previous print jobs. For example, the monitoring unit 208 may determine that a heating element was energized "2" times for a period of "0.3" seconds during processing of a first print job. Further, the monitoring unit 208 may determine that the same heating element was energized "5" times for a duration of "1.0" second during processing of a second print job. In such an example, the monitoring unit 208 may determine the cumulative energization count for heating element as "7". Further, in such an embodiment, the monitoring unit 208 may determine the cumulative energization duration for the heating element as "1.3" seconds.

At step 304, the printer apparatus 106 may include means, such as the control system 110 the monitoring unit 208, or the like for generating the utilization dataset. In an example embodiment, the monitoring unit 208 may be configured to store the one or more parameters associated with the first set of heating elements 112, as the utilization dataset. For example, the monitoring unit 208 may be configured to store the energization count associated with each heating element in the first set of heating elements 112 and the energization duration associated with each heating element in the first set of heating elements 112, as the utilization dataset. Additionally, or alternately, the monitoring unit 208 may be further configured to store the cumulative energization count and the cumulative energization duration (determined in the step 302), associated with each heating element in the first set of heating elements 112, as the utilization dataset.

It may be contemplated that the scope of the disclosure is not limited to generating the utilization dataset only based on the monitoring steps performed during the printing of the previous print jobs. In an example embodiment, the monitoring of the one or more parameters associated with each heating element in the first set of heating elements 112 may define a continuous process, and the monitoring unit 208 may be configured to perform the monitoring operation during printing of the print job received from the computing device 102 (hereinafter interchangeably referred the current print job). Further, based on the monitoring of the one or more parameters during the printing of the current print job, the monitoring unit 208 may be configured to update the utilization dataset concurrent with performing the print job.

At step 306, the printer apparatus may include means, such as the control system 110, the heating element identification unit 210, or the like for analyzing the utilization dataset pertaining to utilization of the first set of heating elements 112. Based on the analysis of the utilization dataset, the heating element identification unit 210 may be configured to identify the one or more overutilized heating elements from the first set of heating elements 112. Various embodiments pertaining to the analysis of the utilization dataset and identification of the one or more overutilized heating elements have been described in conjunction with FIGS. 4, 5, and 6.

Figure 4:
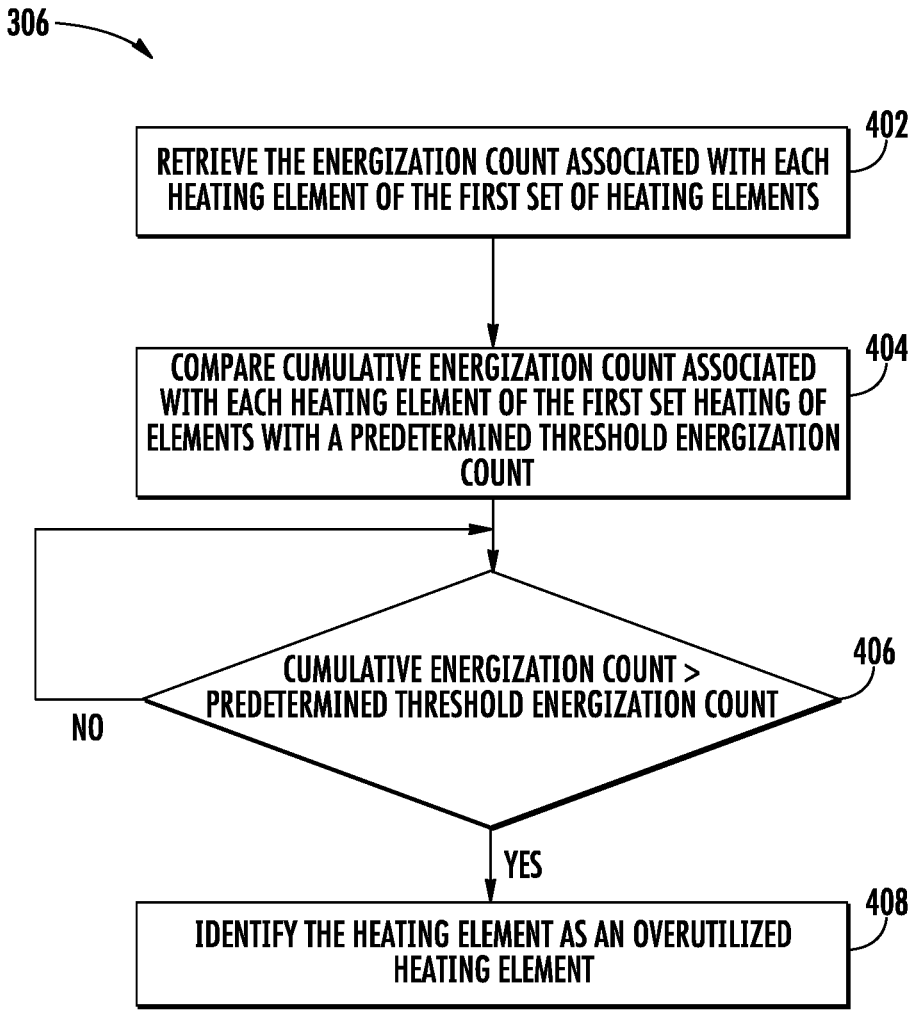
FIG. 4 illustrates a flowchart of a method for analyzing a utilization dataset, in accordance with one or more embodiments of the present disclosure.

FIG. 4 illustrates a flowchart 306 of a method for analyzing the utilization dataset, in accordance with one or more embodiments of the present disclosure.

At step 402, the printer apparatus 106 may include means, such as the control system 110, the heating element identification unit 210, or the like for retrieving the energization count associated with each heating element of the first set of heating elements 112 from the utilization dataset. As discussed above, the energization count, which may be associated with each heating element, may correspond to number of times each heating element has been energized during processing of a print job. Additionally, the heating element identification unit 210 may be further configured to retrieve the cumulative energization count corresponding to a total number of times each heating element of the first set of heating elements 112 has been energized from the utilization dataset. In an example embodiment in which the utilization dataset does not include the cumulative energization count for each heating element, the heating element identification unit 210 may be configured to determine the cumulative energization count for each heating element based on the energization count associated with respective heating element of the first set of heating elements 112. For example, the heating element identification unit 210 may be configured to add the energization count (determined during printing of each of the one or more previous print jobs) associated with a heating element to determine the cumulative energization count associated with the heating element.

At step 404, the printing apparatus may include means, such as the control system 110 the heating element identification unit 210, or the like for comparing the cumulative energization count associated with each heating element with a predetermined threshold energization count. In an example embodiment, the predetermined threshold energization count may correspond to a predefined value of the energization count, which is defined during an initial configuration or manufacturing of the printer apparatus 106. Further, the first threshold value of the energization count may correspond to an upper limit of the energization count that is defined in such a manner that if the cumulative energization count associated with a heating element exceeds the predetermined threshold energization count, the heating element corresponds to the one or more overutilized heating elements. For example, if the predetermined threshold energization count is 10,000 and if the energization count associated with a heating element is 11,000, the heating element is determined to be overutilized.

At step 406, the printer apparatus 106 may include means such as, the control system 110, the heating element identification unit 210, or the like for determining, for a heating element of the first set of heating elements 112, whether the respective cumulative energization count exceeds the predetermined threshold energization count. If the heating element identification unit 210 determines that the cumulative energization count for a heating element has exceeded the predetermined threshold energization count, the heating element identification unit 210 may perform the step 408. However, if the heating element identification unit 210 determines that the cumulative energization count for the heating element has not exceeded the predetermined threshold energization count, the heating element identification unit 210 may repeat the step 406 for the next heating element of the first set of heating elements 112.

At step 408, the printer apparatus 106 may include means such as, the control system 110, the heating element identification unit 210, or the like for identifying the heating element as an overutilized heating element. Thereafter, the heating element identification unit 210 may be configured to repeat the step 406 for the next heating element of the first set of heating elements 112.

In an example embodiment, by repeating the steps 406 and 408, the heating element identification unit 210 may be configured to identify other overutilized heating elements from the first set of heating elements 112.

Figure 5:
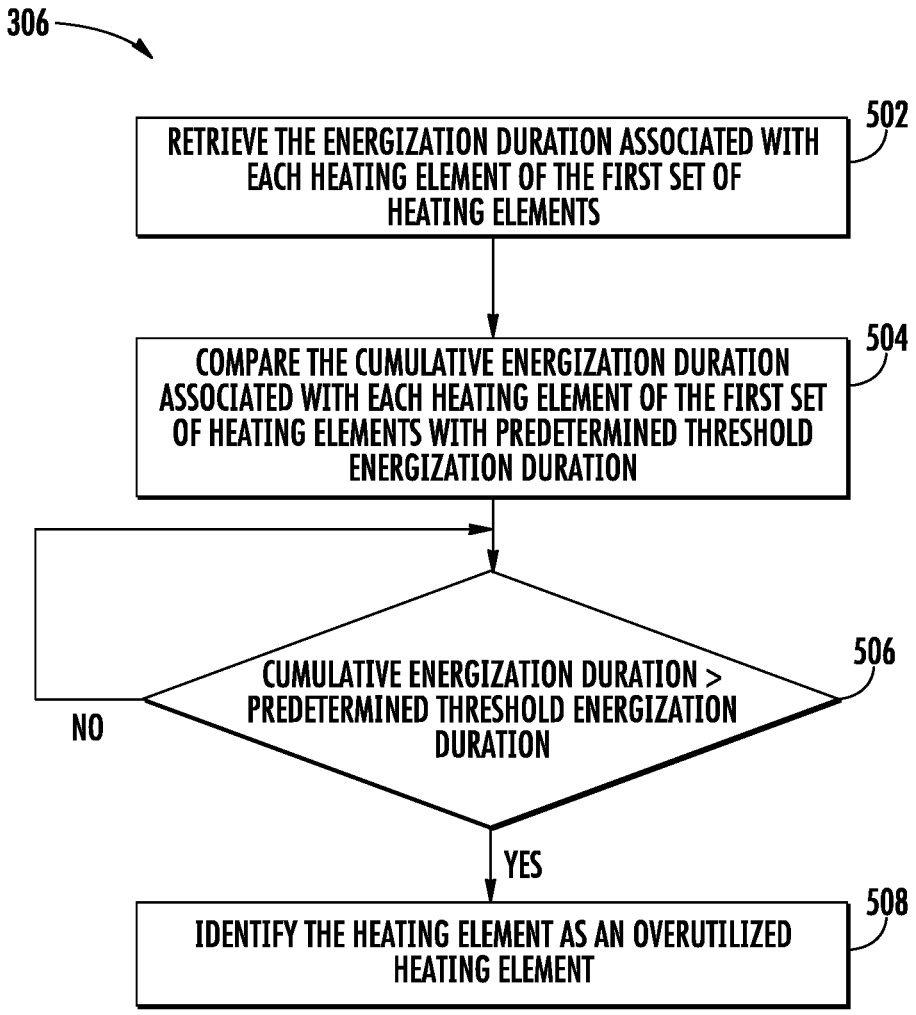
FIG. 5 illustrates another flowchart of a method for analyzing the utilization dataset, in accordance with one or more embodiments of the present disclosure.

FIG. 5 illustrates another flowchart 306 of a method for analyzing the utilization dataset, in accordance with one or more embodiments of the present disclosure.

At step 502, the printer apparatus 106 may include means, such as the control system 110, the heating element identification unit 210, or the like for retrieving the energization duration associated with each heating element of the first set of heating elements 112 (during the printing of the previous print jobs) from the utilization dataset. Additionally, the heating element identification unit 210 may be further configured to retrieve the cumulative energization duration for each heating element of the first set of heating elements 112 from the utilization dataset.

At step 504, the printer apparatus 106 may include means, such as the control system 110 the heating element identification unit 210, or the like for comparing, for each heating element, the cumulative energization duration with a predetermined threshold energization duration.

In an example embodiment, the predetermined threshold energization duration may correspond to a predefined value of duration, which is defined during initial configuration or during manufacturing of the printer apparatus 106. Further, the predetermined threshold energization duration may correspond to an upper limit of duration that is defined in such a manner that if the duration of energization associated with a heating element exceeds the predetermined threshold energization duration, the heating element is determined to be overutilized. For example, if the predetermined threshold energization duration is 50 hours and if the energization duration associated with a heating element is 51 hours, the heating element is determined to be overutilized.

At step 506, the printer apparatus 106 may include means, such as the control system 110, the heating element identification unit 210, or the like for determining whether the energization duration associated with the heating element exceeds the predetermined threshold energization duration. If the heating element identification unit 210 determines that the energization duration associated with the heating element exceeds the predetermined threshold energization duration, the heating element identification unit 210 performs the step 508. However, if the heating element identification unit 210 determines that the cumulative energization duration for the heating element has not exceeded the predetermined threshold energization duration, the heating element identification unit 210 repeats the step 506 for the next heating element of the first set of heating elements 112.

At step 508, the printer apparatus 106 may include means, such as the control system 110 the heating element identification unit 210, or the like for identifying the heating element as an overutilized heating element. Thereafter, the heating element identification unit 210 may repeat the step 506 for the next heating element. In an example embodiment, by repeating the steps 506 and 508, the heating element identification unit 210 may be configured to identify other overutilized heating elements from the first set of heating elements 112.

It may be contemplated that the scope of the disclosure is not limited to identifying the one or more overutilized heating elements based on either the comparison performed in the step 404 (i.e., comparison between the cumulative energization count and the predetermined threshold energization count) or the comparison performed in the step 504 (i.e., comparison between the cumulative energization duration and the predetermined threshold energization duration). In another example embodiment, the heating element identification unit 210 may identify the one or more overutilized heating elements when both the energization count and the energization duration exceed the respective threshold values (i.e., the predetermined threshold energization count and the predetermined threshold energization duration). In other embodiments, the energization count associated with a heating element exceeds the predetermined threshold energization count; however, the energization duration associated with the heating element has not exceeded the predetermined threshold energization duration. In such an embodiment, the heating element identification unit 210 may not identify the heating element as the overutilized heating element. Said differently, the heating element identification unit 210 may only identify the heating element as the overutilized heating element in an instance in which both the energization count and the energization duration, associated with the heating element, exceed their respective threshold values.

In yet another example embodiment, the heating element identification unit 210 may prioritize between the comparison of the energization count with the predetermined threshold energization count, and the comparison of the energization duration with the predetermined threshold energization duration, to identify the one or more overutilized heating elements. For example, the heating element identification unit 210 may prioritize the comparison of the energization duration of energization with the predetermined threshold energization duration, over the comparison of the energization count with the predetermined threshold energization count. In such an embodiment, the heating element will be determined to be overutilized only in an instance in which the energization duration of energization associated with the heating element exceeds the predetermined threshold energization duration. If, for example, the energization count associated with the heating element exceeds the predetermined threshold energization count, while the energization duration associated with the heating element has not exceeded the predetermined threshold energization duration, the heating element identification unit 210 may not identify the heating element as the overutilized heating element.

While described above with reference to energization count and duration, the present disclosure further contemplates that, in some embodiments, cycle on time may be used to determine if a heating element is overutilized. By way of example, in some embodiments, heating elements may be arranged in rows in conjunction with a stepping motor such that a printing operation is performed by energizing a first row of heating elements, stepping the motor to the next row of heating elements, and energizing the next row (e.g., and subsequent rows) of heating elements to perform the printing job (e.g., any print operation that applies an image to physical media). In such an embodiment, a cycle refers to the time between steps performed by the stepping motor and on time refers to the period of time during each step in which the heating elements of the corresponding row are energized. In this way, count on time refers to a percentage of the time in which a heating element is energized during a step such that a higher percentage value is indicative of a shorter resting time for the heating element. As would be evident to one of ordinary skill in the art, the larger the cycle on time percentage, the more likely the heating element is overutilized in that the heating element has less time to cool down between operations.

It may be noted that the scope of the disclosure is not limited to the analysis of the utilization dataset including the comparison of the energization count and the energization duration with respective threshold values. In alternate embodiment, the heating element identification unit 210 may be configured to analyze the utilization dataset to determine a likelihood to fail for each heating element of the first set of heating elements 112. Further, based on the determined likelihood to fail associated with each heating element of the first set of heating elements 112, the heating element identification unit 210 may be configured to identify the one or more overutilized heating elements. The identification of the one or more overutilized heating elements based on the likelihood to fail has been described in conjunction with FIG. 6.

Figure 6:
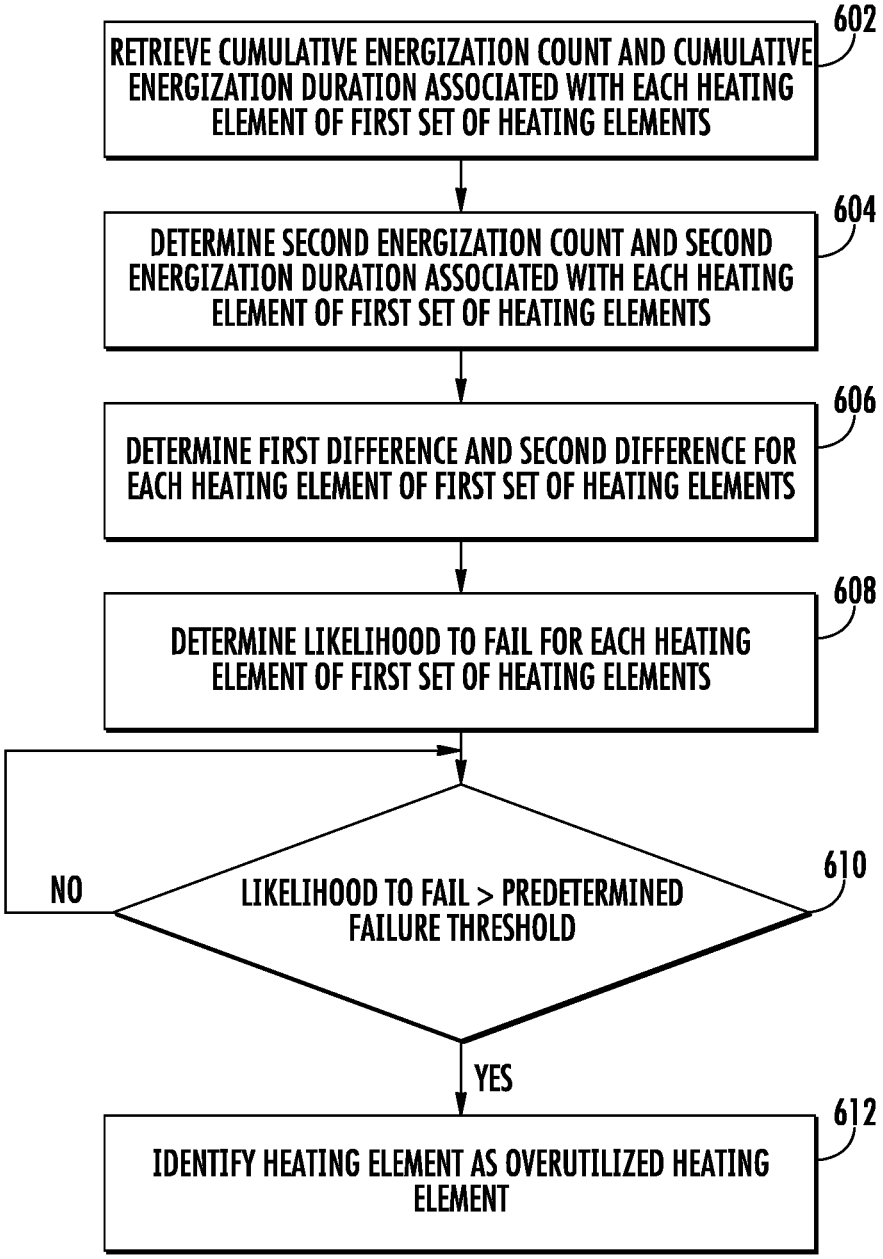
FIG. 6 illustrates yet another flowchart of a method for analyzing the utilization dataset, in accordance with one or more embodiments of the present disclosure.

FIG. 6 illustrates another flowchart 306 of a method for analyzing the utilization dataset, in accordance with one or more embodiments of the present disclosure. At step 602, the printer apparatus 106 may include means, such as the control system 110, the heating element identification unit 210, or the like for retrieving the cumulative energization count associated with each heating element of the first set of heating elements 112 and the cumulative energization duration associated with each heating element of the first set of heating elements 112, from the utilization dataset.

At step 604, the printer apparatus 106 may include means, such as the control system 110, the heating element identification unit 210, or the like for determining a second energization count and a second energization duration for each heating element of the first set of heating elements 112. In an example embodiment, the second energization count associated with a heating element may correspond to a remaining number of times the heating element is energizable (e.g., may be energized). Similarly, the second energization duration may correspond to a remaining time period for which the heating element is energizable. In an example embodiment, the second energization count and the second energization duration may be deterministic of a remaining life of the first set of heating elements 112. To determine the life of each heating element of the first set of heating elements 112, the heating element identification unit 210 may be configured to retrieve information pertaining to a maximum energization count that a heating element can be energized and a maximum energization duration for which the first set of heating elements 112 may be energized. In an example embodiment, the maximum energization count and the maximum energization duration may be predefined during manufacturing of the printer apparatus 106. Further, the maximum energization count and the maximum energization duration correspond to values of count and duration, respectively, beyond which the heating element will fail. In an example embodiment, if the cumulative energization count and the cumulative energization duration associated with a heating element exceeds the maximum energization count and the maximum energization duration, respectively, the heating element fails. In an example embodiment, the maximum energization count and the maximum energization duration may be different from the predetermined threshold energization count and the predetermined threshold energization duration, respectively. In alternate embodiment, the maximum energization count and the maximum energization duration may be the same as the predetermined threshold energization count and the predetermined threshold energization duration, respectively.

At step 606, the printer apparatus 106 may include means, such as the control system 110, the heating element identification unit 210, or the like for determining a first difference between the cumulative energization count associated each heating element and the maximum energization count, and a second difference between the cumulative energization duration and the maximum energization duration. In such an example embodiment, the first difference may be indicative of the second energization count for which a heating element of the first set of heating elements 112 is energizable. In an example embodiment, the second difference may be indicative of the second energization duration for which the heating element of the first set of heating elements 112 is energizable. As is evident by the difference determination above, in an instance in which the energization count exceeds the maximum energization count, the first difference may be a negative value. This negative value may, in some embodiments, indicate that the heating element has failed (e.g., has exceeded the maximum energization count for the heating element). Said differently, the likelihood to fail determined at step 608 below may in some embodiments only be calculated for heating elements that have not exceed the maximum energization count (e.g., have not already failed).

At step 608, the printer apparatus 106 may include means, such as the control system 110, the heating element identification unit 210, or the like for determining the likelihood to fail for each heating element of the first set of heating elements 112, based on the first difference and the second difference, associated with each heating element of the first set of heating elements 112. In an example embodiment, the heating element identification unit 210 may utilize one or more known techniques such as, but not limited to, naïve Bayes theorem, to determine the likelihood to fail for each heating element based on the first difference and the second difference (determined for each heating element of the first set of heating elements 112). In an example embodiment, the likelihood to fail for a heating element is inversely proportional to the first difference and the second difference determined for each heating element of the first set of heating elements 112. For example, the first difference for a first heating element is 10, and the first difference for a second heating element is 5, the likelihood of the second heating element to fail is greater than the likelihood of the first heating element to fail.

At step 610, the printer apparatus 106 may include means, such as the control system 110, the heating element identification unit 210, or the like for determining whether the likelihood to fail, associated with a heating element of the first set of heating elements 112 exceeds a predetermined likelihood failure threshold. In an example embodiment, the predetermined likelihood failure threshold may correspond to a predefined value of likelihood, which is defined during initial configuration or during manufacturing of the printer apparatus 106. Further, the predetermined likelihood of failure threshold may correspond to an upper limit of likelihood that is defined in such a manner that if the likelihood to fail associated with a heating element exceeds the predetermined likelihood of failure threshold, the heating element is determined to be overutilized. For example, if the predetermined likelihood failure threshold 0.6 and the likelihood to fail associated with a heating element is 0.7, the heating element identification unit 210 determines that the heating element is overutilized.

If the heating element identification unit 210 determines that the likelihood to fail associated with the heating element exceeds the predetermined likelihood failure threshold, the heating element identification unit 210, at step 612, may determine that the heating element is overutilized. However, if the heating element identification unit 210 determines that the likelihood to fail associated with the heating element has not exceeded the predetermined likelihood failure threshold, the heating element identification unit 210 may repeat the steps 610 for other heating elements of the first set of heating elements 112.

It may be understood by a person having ordinary skills in the art that aforementioned embodiments for analyzing the utilization dataset have been provided for illustrative purposes. In an example embodiment, various other techniques for analyzing the utilization dataset may be employed without departing from the scope of the disclosure.

Referring back FIG. 3, at step 308, the printer apparatus 106 may include means, such as the control system 110, the heating element identification unit 210, for identifying the second set of heating elements. In an example embodiment, the heating element identification unit 210 may identify the heating elements in the first set of heating elements 112, exclusive of the one or more overutilized heating elements, as the second set of heating elements. In an example embodiment, the second set of heating elements includes heating elements that are underutilized in comparison the utilization of the one or more overutilized heating elements.

At step 310, the printer apparatus 106 may include means, such as the control system 110, the heating element identification unit 210, or the like for generating a notification, in response to the identification of the one or more overutilized heating elements. In an example embodiment, prior to generating the notification, the notification unit 212 may be configured to retrieve the one or more parameters associated with the first set of heating elements 112 from the memory device 204. As discussed above, the one or more parameters associated with the first set of heating elements 112 include the position of each of the first set of heating elements 112 in the print head arrangement 108, the energization count associated with each heating element of the first set of heating elements 112, the energization duration associated with each heating element of the first set of heating elements 112, and the likelihood to fail associated with each heating element of the first set of heating elements 112.

Thereafter, the notification unit 212 may be configured to represent the values of the one or more parameters in form of a graphical representation such as, but not limited to, a histogram. For example, the notification unit 212 may be configured to generate at least one histogram, indicative of the utilization of the first set of heating elements 112, based on the energization count associated with each heating element of the first set of heating elements 112, and the position associated with each heating element of the first set of heating elements 112. In another example, the notification unit 212 may be configured to generate another histogram based on the energization duration associated with each heating element of the first set of heating elements 112 and the position associated with each heating element of the first set of heating elements 112. An exemplary histogram is illustrated in FIG. 7.

Figure 7:
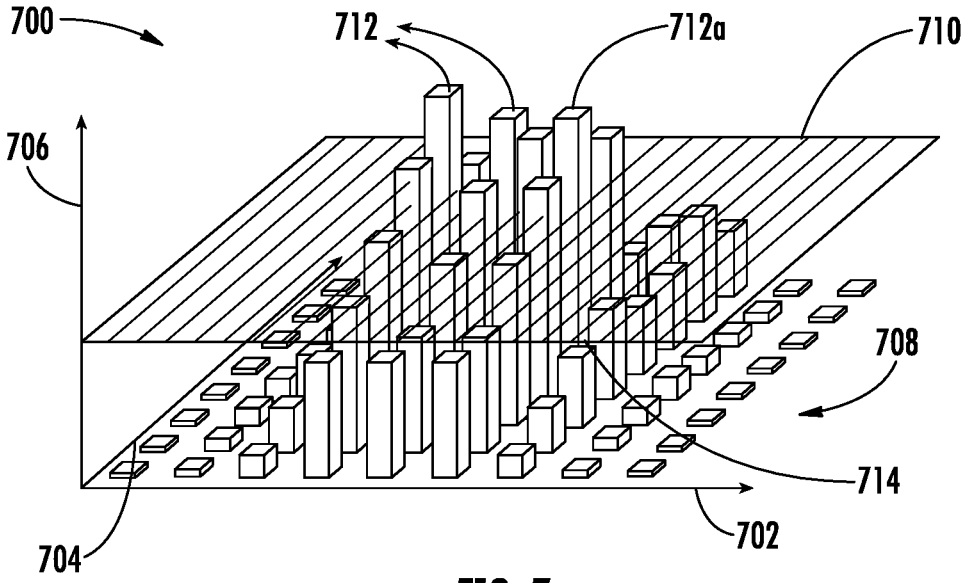
FIG. 7 illustrates an exemplary histogram depicting utilization of the plurality of heating elements, in accordance with one or more embodiments of the present disclosure.

Referring to FIG. 7, a histogram 700 is illustrated. It can be observed that the histogram 700 includes an X-axis 702, a Y-axis 704, and a Z-axis 706. In an example embodiment, the X-axis 702 and the Y-axis 704 define an X-Y plane 708. Each point on the X-Y plane 708 represents a heating element of the first set of heating elements 112. Further, the points in the X-Y plane are arranged in accordance with a position of the corresponding heating element on the print head arrangement 108. For example, if a first heating element is positioned adjacent to a second heating element on the print head arrangement 108, the point representing the first heating element in histogram 700 will be positioned adjacent to a point representing the second heating element. The Z-axis 706 represents the energization count associated with a heating element (represented by a point in the X-Y plane 708). Further, it can be observed that the histogram 700 includes a plane 710 that is parallel to the X-Y plane 708. In an example embodiment, the Z-coordinate of the plane 710 represents the predetermined threshold energization count.

Further, it can be observed that the histogram 700 includes a plurality of bars (depicted by 712) that originate from the points in the X-Y plane 708. Each bar of the plurality of bars represents the energization count associated with a heating element represented by a point in the X-Y plane 708. For example, the bar 712*a* represents the energization count associated with a heating element represented by a point 714 in the X-Y plane 708. Further, it can be observed that one or more bars of the plurality of bars (depicted by 712) surpass the plane 710. In an example embodiment, the energization count represented by the one or more bars is greater than the predetermined threshold energization count represented by the plane 710. In an example embodiment, the heating elements associated with the one or more bars correspond to the one or more overutilized heating elements in the print head arrangement 108.

It may be contemplated that the scope of the disclosure is not limited to generating the histogram to represent in the utilization of the first set of heating elements 112. In other example embodiments, other graphical representations may be used to represent the utilization of the first set of heating elements 112.

With continued reference to FIG. 3, after generating the at least one histogram, the notification unit 212 may be configured to generate the notification. In an example embodiment, the notification may include the generated histogram.

Additionally or alternatively, the notification may further include information pertaining to the life of each heating element of the first set of heating elements 112 (determined in the step 604). As discussed above, the information pertaining to the life of the first set of heating elements 112 includes the second energization count associated with each heating element of the first set of heating elements 112 and the second energization duration associated with each heating element of the first set of heating elements 112. In some embodiments, the information pertaining to the life may further include the likelihood to fail associated with heating element of the first set of heating elements 112.

In an example embodiment, the notification may further include information pertaining to the life of the print head arrangement 108 as whole. In an example embodiment, the life of the print head arrangement 108 may be determined based on the likelihood to fail associated with each heating element of the first set of heating elements 112 in the print head arrangement 108. In an example embodiment, the notification unit 212 may be configured to determine the life of the print head arrangement 112 as a whole. For example, to determine the life of the print head arrangement 108, the notification unit 212 may be configured to determine a cumulative likelihood of the first set of heating elements 112 based on the individual likelihood to fail associated with each heating element of the first set of heating elements 112. In an example embodiment, the cumulative likelihood may be indicative of the life of the print head arrangement 108. For example, the cumulative likelihood associated with the first set of heating elements 112 is "0.8". Therefore, the likelihood of the print head arrangement 108 to fail is "0.8". Such information pertaining to the likelihood of the print head arrangement 108 to fail is included in the notification.

Further, the notification unit 212 may be configured to transmit the generated notification to the computing device 102. In an example embodiment, the notification unit 212 may be further configured to activate the LED on the printer apparatus 106. Additionally, the notification unit 212 may be configured to display the histogram on the display device of the printer apparatus 106.

In an example embodiment, in response to the identification of the one or more overutilized heating elements, the control system 110 may be configured to process the incoming print jobs. The processing of the print jobs has been described in conjunction with FIG. 8.

Figure 8A:
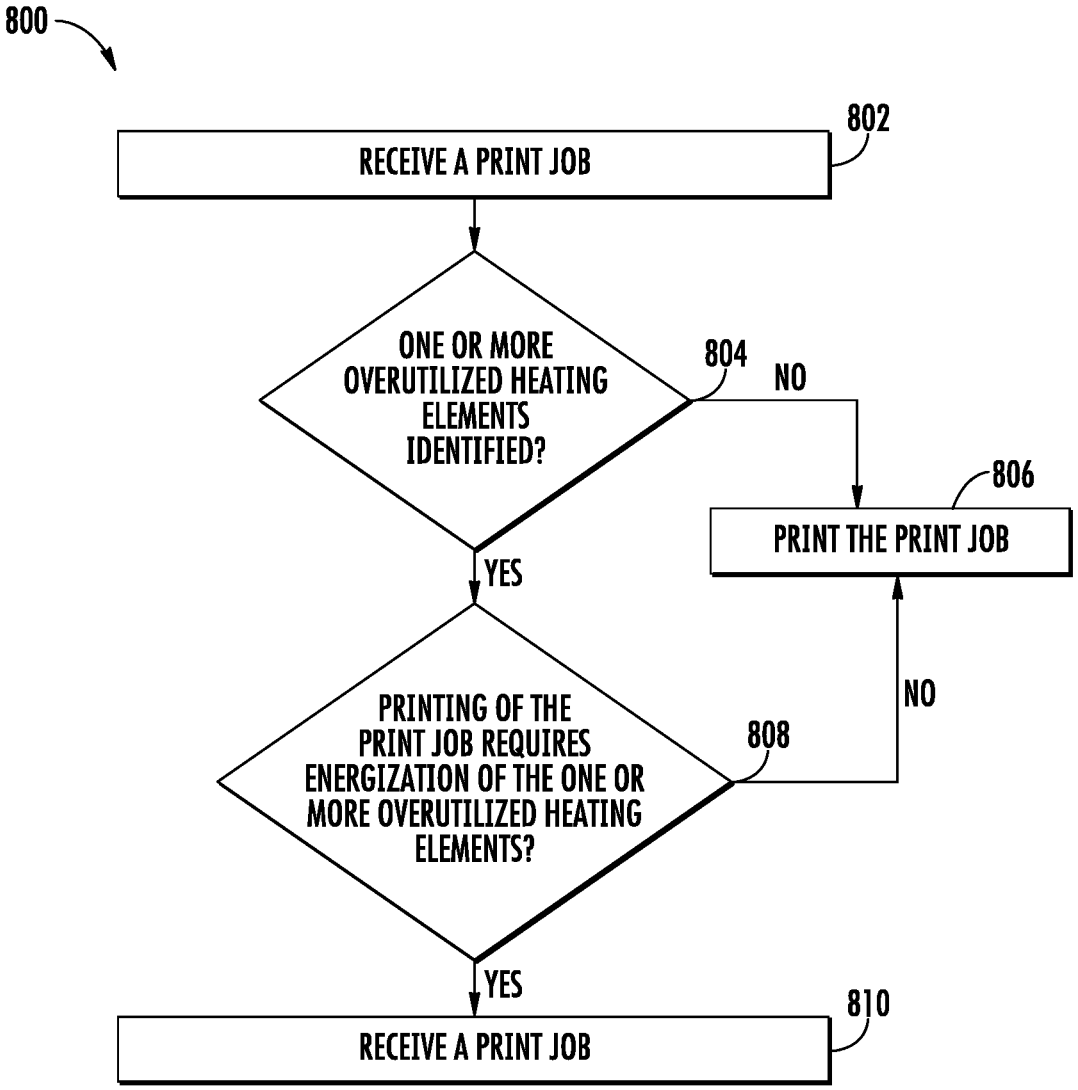
FIGS. 8*a*-8*b* illustrate flowcharts of a method for processing a print job, in accordance with one or more embodiments.

FIG. 8*a* illustrates a flowchart 800 of a method for processing a print job, in accordance with one or more embodiments.

At step 802, the printer apparatus 106 may include means, such as the control system 110, the controller 202, or the like for receiving a print job. As discussed above, the print job may include data to be printed along with the information pertaining to the position or location to which the data in the print job is to be printed on the print medium.

At step 804, the printer apparatus 106 may include means, such as the control system 110, the print job modification unit 214, or the like for determining whether the one or more overutilized heating elements have been identified. In an example embodiment, the print job modification unit 214 may be configured to retrieve the one or more parameters associated with the one or more overutilized heating elements from the memory device 204. If the information pertaining to the one or more parameters associated with the one or more overutilized heating elements is present in the first memory device 204, the print job modification unit 214 may determine that the one or more overutilized heating elements have been identified. If the information pertaining to the one or more parameters associated with the one or more overutilized heating elements is not present in the first memory device 204, the print job modification unit 214 determines that the one or more overutilized heating elements have not yet been identified. If the print job modification unit 214 determines that the one or more overutilized heating elements have not been identified, the print job modification unit 214 may be configured to perform the step 806. If the print job modification unit 214 determines that the one or more overutilized heating elements have been identified, the print job modification unit 214 may be configured to perform the step 808. At step 806, the printer apparatus 106 may include means, such as the control system 110, the controller 202, or the like for printing the print job.

At step 808, the printer apparatus 106 may include means, such as the control system 110, and the print job modification unit 214, for determining whether the printing of the print job requires energization of the one or more overutilized heating elements. In an example embodiment, the print job modification unit 214 may be configured to retrieve the position of the data to be printed from the print job (for example, the position of the data is (5,6)). Thereafter, the print job modification unit 214 may be configured to identify an original set of heating elements of the first set of heating elements 112 that will be utilized to print the data in the print job, based on the position of the data retrieved from the print job. For example, the print job modification unit 214 determines that to print the data at the position (5,6), the heating element at the position (2,2) needs to be energized. Therefore, the print job modification unit 214 identifies the heating element at the position (2,2) as the original set of heating elements that will be used to print the print job. Similarly, the print job modification unit 214 identifies other heating elements that will utilized to print the print job, along with their position on the print head arrangement 108.

Subsequently, the print job modification unit 214 determines whether the original set of heating elements include heating elements that corresponds to the one or more overutilized heating elements. In an embodiment, the print job modification unit 214 may be configured to cross reference the position of each heating element in the original set of heating elements with the position of the one or more overutilized heating elements (stored as the one or more parameters) to determine whether the one or more heating elements include the one or more overutilized heating elements. For example, the print job modification unit 214 may determine that the heating element at the position (2,2) corresponds to an overutilized heating element.

For example, (with reference to FIG. 7), the print job modification unit 214 may determine that data is to be printed at the position (x1, y1) on the print medium. Based on the position of the data to be printed on the print medium, the print job modification unit 214 may determine that at least the heating element depicted by the point 714 (referring to FIG. 7) will be energized to print the print job. From the histogram 700, it can be observed that the heating element depicted by the point 714 is overutilized. Therefore, the print job modification unit 214 may determine that the printing of the print job requires the energization of the one or more overutilized heating elements. If at step 808, the print job modification unit 214 determines that the printing of the print job requires energization of the one or more overutilized heating elements, the print job modification unit 214 may perform the step 810. However, if the print job modification unit 214 determines that printing of the print job does not require the energization of the overutilized heating element, the print job modification unit 214 performs the step 806.

It may be noted that the step 808 is optional. In an alternate embodiment, the print job may be modified without determining whether the printing of the print job requires the energization of the one or more overutilized heating elements. In such an embodiment, in response to the identification of the one or more overutilized heating elements, the step 810 is performed for every print job.

At step 810, the printer apparatus 106 may include means, such as the control system 110, the print job modification unit 214, or the like for processing the print job. The processing of the print job has been further described in conjunction with FIG. 8*b*.

Figure 8B:
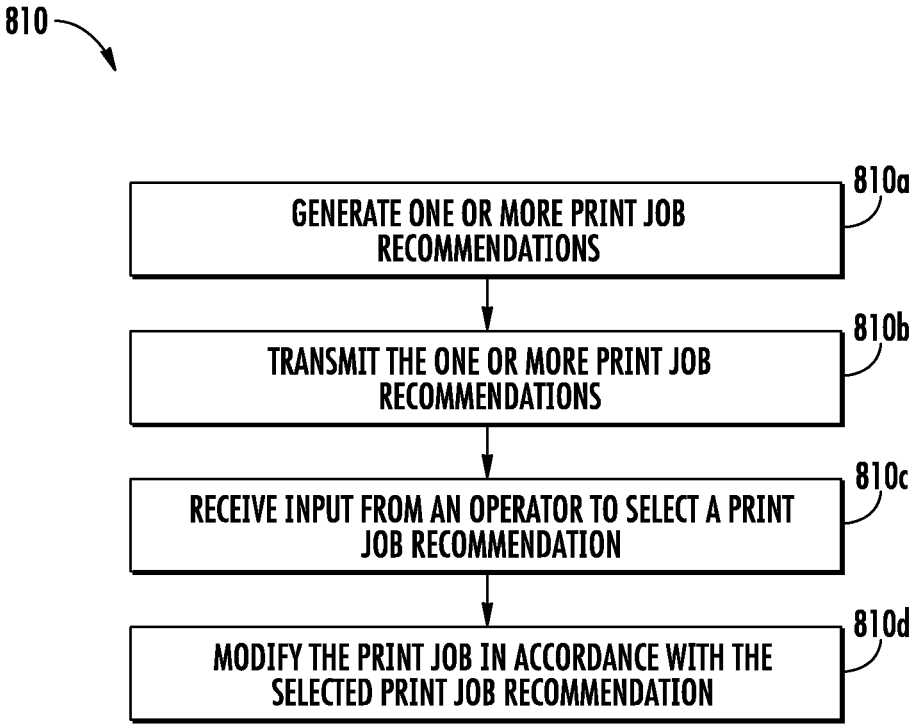

FIG. 8*b* illustrates a flowchart 810 of a method for processing the print job, in accordance with one or more embodiments.

At step 810*a*, the printer apparatus 106 may include means, such as the control system 110, the print job modification unit 214, or the like for generating the one or more print job recommendations. In an example embodiment, the one or more print job recommendations may entail possible modifications to the print job.

To generate the one or more print job recommendations, the print job modification unit 214 may be configured to determine the one or more characteristics of the data in the print job that can be modified. In an example embodiment, the one or more characteristics associated with data may include, but are not limited to, a size of the data, and a position of the data. When the data includes text data, the one or more characteristics may further include a font type of the data.

For example, originally, the print job modification unit 214 may determine that the position of the data is such that the printing of the data (defined in the print job) will require energization of the original set of heating elements that includes the one or more overutilized heating elements. To avoid overutilization of the one or more overutilized heating elements, the print job modification unit 214 may determine that the position of the data to be printed can be shifted left or right of the original position such that a different set of heating elements is energized during the printing of the modified print job. In an example embodiment, the print job modification unit 214 may be configured to identify available space to the left and right of position of the data. In an example embodiment, the available space may be identified based on the print job. As discussed above, the print job defines the position where the data is to be printed on the print medium. Therefore, based on the print job, the print job modification unit 214 determines position where the data is not to be printed. Such positions constitute available space. Based on the position of the data defined in the print job, the print job modification unit 214 may be configured to identify the available space, left and right of the position of the data, on the print medium. Accordingly, the print job modification unit 214 may determine that the position of the print job can be shifted in such a manner that a portion of the data is printed in the available space (identified by the print job modification unit 214). The shifting of the data in the print job has been described later in conjunction with FIG. 9.

In another example, the print job modification unit 214 may be configured to determine that the size of the data can be modified such that a portion of the data of modified size is printed in the available space. In yet another example, the print job modification unit 214 may be configured to determine that the font type of the data can be modified. Therefore, by modifying the one or more characteristics of the data, the different set of heating elements will be energized during printing of the modified print job.

In some example embodiments, the different set of heating elements may include one or more heating elements from the second set of heating elements and one or more heating elements from the one or more overutilized heating elements. In another example embodiments, the different set of heating elements may only include heating elements selected from the second set of heating elements. Various examples of selection of the different set of heating elements have been illustrated in FIGS. 9-11.

In an example embodiment, the print job modification unit 214 may consider the aforementioned modifications, which can be made to the one or more characteristics of the data in the print job, as the one or more print job recommendations. A person having ordinary skills in the art would appreciate that the scope of the disclosure is not limited to considering only the aforementioned possible modifications as the one or more print job recommendations. In an example embodiment, the print job modification unit 214 may be configured to determine additional modifications that can be made to the data in the print job based on a combination of the aforementioned modifications. For example, an additional modification may include modifying the size of the data to be printed along with shifting the position of the data. In an example embodiment, the print job modification unit 214 may consider such additional modifications as the one or more print job recommendations. Various examples of the possible modification that can be made to the print job have been described in conjunction with FIGS. 9, 10, and 11.

After the generation of the one or more print job recommendations, the print job modification unit 214 may determine a percentage of the one or more overutilized heating elements in the different set of heating elements (that will be energized during printing of the modified print job). For example, the print job modification unit 214 may determine that, for a recommendation corresponding to shifting of the position of the data, 40% of the different set of heating elements correspond to the one or more overutilized heating elements. Similarly, the print job modification unit 214 may be configured to determine the percentage of overutilized heating elements in the different set of heating elements corresponding to the other recommendations. Thereafter, the print job modification unit 214 may be configured to store the one or more print job recommendations in the first memory device 204.

At step 810*b*, the printer apparatus 106 may include means, such as the control system 110, the notification unit 212, or the like for transmitting the one or more print job recommendations to the computing device 102. In addition to the one or more print job recommendations, the notification unit 212 may further transmit the information pertaining to the percentage of the one or more overutilized heating elements in the different set of heating elements associated with the respective recommendations. In alternate embodiment, the notification unit 212 may be configured to display the one or more print job recommendations along with the information pertaining to the percentage of the overutilized heating elements on the display device associated with the printer apparatus 106.

At step 810*c*, the printer apparatus 106 may include means, such as the control system 110, the notification unit 212, or the like for receiving an input from the operator to select a print job recommendation of the one or more print job recommendations. On receiving the input, the notification unit 212 may be configured to transmit the selected print job recommendation to the print job modification unit 214.

At step 810*d*, the printer apparatus 106 may include means, such as the control system 110, the notification unit 212, or the like for modifying the print job. In an example embodiment, the print job modification unit 214 may be configured to modify the print job in accordance with the selected print job recommendation. For example, the print job recommendation selected by the operator of the printer apparatus 106 corresponds to shifting of the position of the data. Therefore, the print job modification unit 214 may shift the position of the data in the print job. Various examples of modifying the print job have been illustrated in FIGS. 9-11

In some example embodiments, the scope of the disclosure is not limited to presenting the one or more print job recommendations to the operator and accordingly receiving input to select the print job recommendation. In alternate embodiment, the print job modification unit 214 may be configured to automatically select the print job recommendation of the one or more print job recommendations based on the percentage of the one or more overutilized heating elements in the different set of heating elements associated with each of the one or more print job recommendations. For instance, the print job modification unit 214 may select a print job recommendation having minimum percentage of overutilized heating elements in the respective different set of heating elements. For example, the print job modification unit 214 may determine that the different set of heating elements corresponding to a first print job recommendation (for example, shifting of position of data) includes 40% overutilized heating elements. Further, the print job modification unit 214 may determine the different set of heating elements corresponding to a second print job recommendation (for example, changing the size of the data) includes 30% overutilized heating elements. In such a scenario, the print job modification unit 214 may select the second print job recommendation to modify the print job.

Referring back to FIG. 8*a*, at step 814, the printer apparatus 106 may include means, such as the control system 110, the controller 202, or the like for printing the processed print job.

Figure 9:
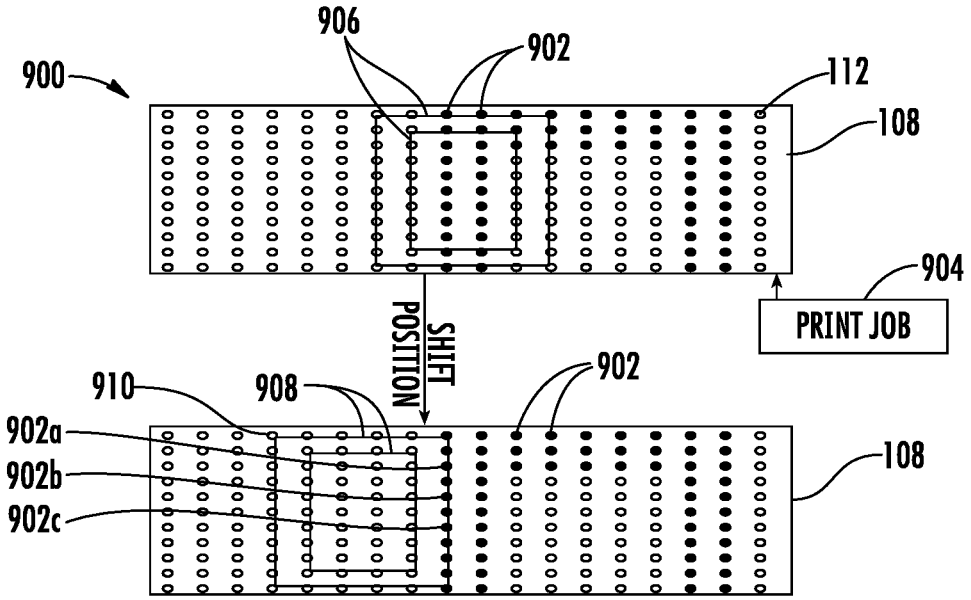
FIG. 9 illustrates an example processing of a print job, in accordance with one or more embodiments.

FIG. 9 illustrates an exemplary scenario 900 depicting a modification that can be made to the print job, in accordance with one or more embodiments. The exemplary scenario 900 has been described in conjunction with FIGS. 1-8.

The exemplary scenario 900 illustrates the print head arrangement 108. From FIG. 9, it can be observed that the print head arrangement 108 includes the first set of heating elements 112. Further, it can be observed from FIG. 9 that the one or more heating elements of the first set of heating elements 112 are darkened (depicted by 902). The darkened heating elements (depicted by 902) correspond to the one or more overutilized heating elements. A person having ordinary skill in the art would appreciate that the heating elements have been darkened for distinctive purposes only.

For the purpose of the exemplary scenario 900, in some example embodiments, a print job 904 is received. The print job 904 includes a character "0" that needs to be printed. Further, the position of the character "0" defined in the print job 904 is such that an original set of heating elements (encompassed by an outline 906) that needs to be energized to print the character "0" includes the one or more overutilized heating elements (depicted by 902).

To reduce the overutilization of the one or more overutilized heating elements (depicted by 902), the print job modification unit 214 shifts the position of the character "0" to left of the original position of the character "0". Printing of the shifted character "0" requires energization of the different set of heating elements (encompassed by an outline 908). The different set of heating elements (encompassed by the outline 908) includes the one or more overutilized heating elements (for example 902*a*, 902*b*, and 902*c*) and the second set of heating elements (depicted by 910).

A person having ordinary skill in the art would appreciate that the scope of the disclosure is not limited to shifting the position of the data in the print job to left of the original position. In an example embodiment, the position of the data can be shifted to any other position, without departing from the scope of the disclosure. Further, the person having ordinary skills in the art would appreciate that the scope of the disclosure is not limited to automatically shifting the position of the data in the print job. In an alternate embodiment, the control system 110 may receive an input from the operator of the printer apparatus 106 to shift the position of the data in the print job.

Figure 10:
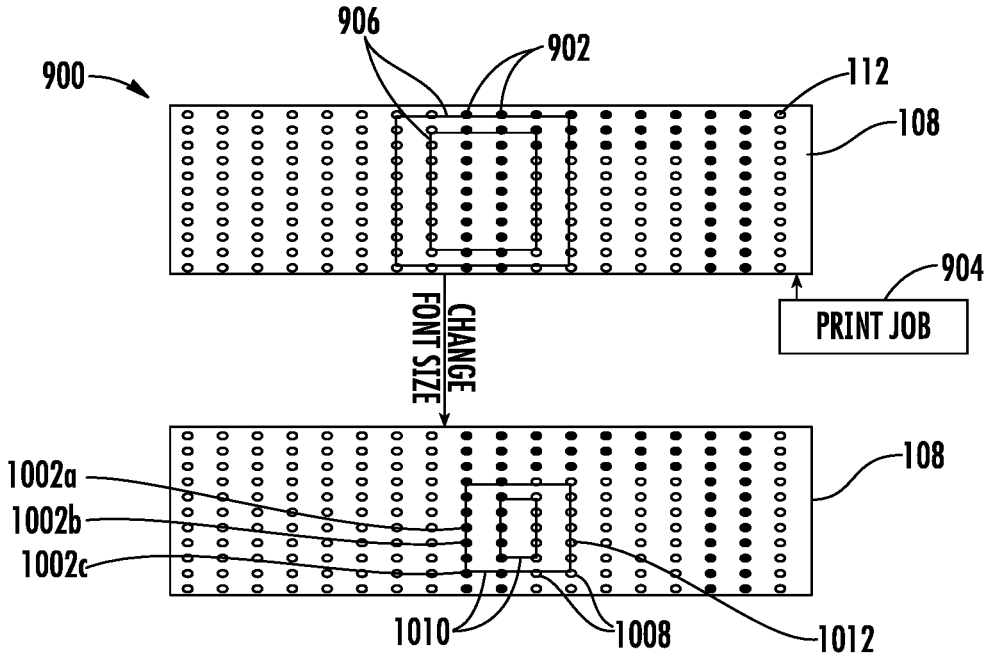
FIG. 10 illustrates an example processing of a print job, in accordance with one or more embodiments.

FIG. 10 illustrates another exemplary scenario 1000 depicting a modification that can be made to the print job, in accordance with one or more embodiments.

The exemplary scenario 1000 illustrates an exemplary modification where the font size of the character "0" (in the print job 1004) is reduced from the original font size. Further, from FIG. 10, it can be observed that the printing of the character "0" of original font size requires energization of the one or more overutilized heating elements 1002 (encompassed by outline 1006). However, the printing of the reduced sized character "0" requires energization of the different set of heating elements 1008 (encompassed by an outline 1010).

It can be observed that the heating elements in the different set of heating elements includes the one or more overutilized heating elements (for example 1002*a*, 1002*b*, and 1002*c*) and the second set of heating elements 1012.

Figure 11:
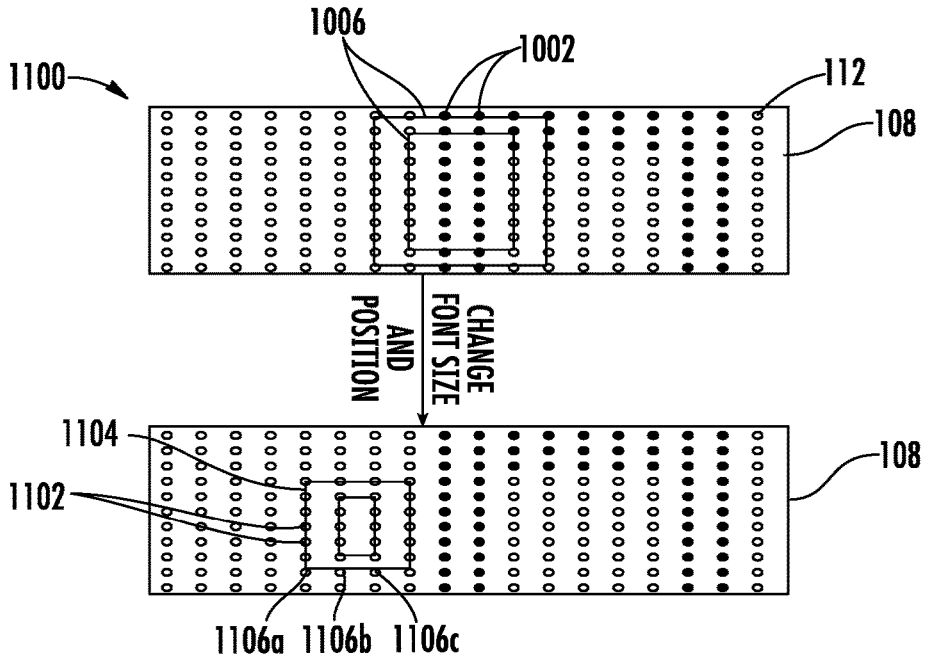
FIG. 11 illustrates an example processing of a print job, in accordance with one or more embodiments.

FIG. 11 illustrates another exemplary scenario 1100 depicting a modification that can be made to the print job, in accordance with one or more embodiments.

The exemplary scenario 1100 illustrates a modification in which both the position of the data and the size of the data to be printed are modified. In the exemplary scenario 1100, it can be observed that the printing of the character "0" of original font size requires energization of the one or more overutilized heating elements 1002 (encompassed by the outline 1006). In the exemplary scenario 1100, it can be observed that the font size of the character "0" is reduced from the original font size as well as the position of the character "0" is shifted to the left of the original position of the character. The printing of such modified character requires energization of different set of heating elements 1102 (encompassed by an outline 1104). The first set of heating elements includes heating elements only from the second set of heating elements (for example 1106*a*, 1106*b*, and 1106*c*).

Having described the architecture of the printer apparatus 106 and various processes performed by the printer apparatus 106, the operation and the architecture of the computing device 102 has been described hereafter.

Figure 12:
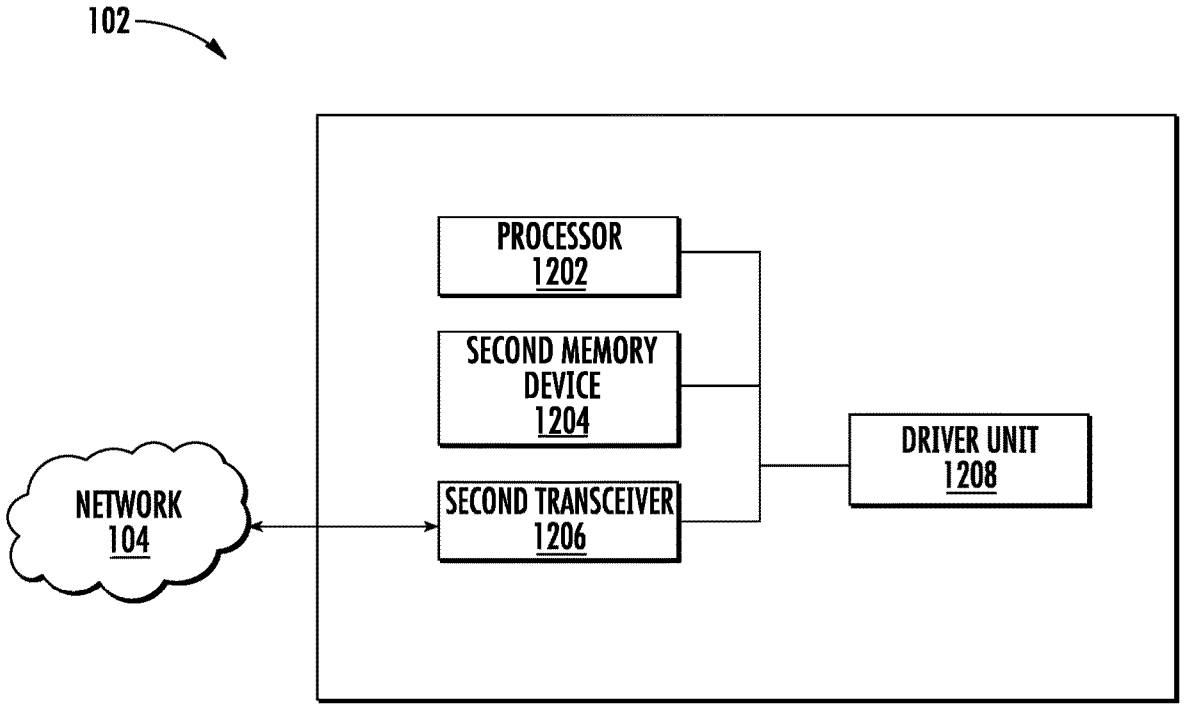
FIG. 12 illustrates a block diagram of a computing device, in accordance with the one or more embodiments of the present disclosure.

FIG. 12 illustrates a block diagram of a computing device 102, in accordance with the one or more embodiments of the present disclosure. The computing device 102 includes a processor 1202, a second memory device 1204, a second communication interface 1206, and a driver unit 1208. Each of the second memory device 1204, the second communication interface 1206, and the driver unit 1208, are communicatively coupled to the processor 1202.

The processor 1202 may include suitable logic, circuitry, and/or interfaces that are operable to execute one or more instructions stored in the second memory device 1204 to perform a predetermined operation. The processor 1202 may be implemented using one or more processor technologies known in the art. Examples of the processor 1202 include, but are not limited to, an x86 processor, an ARM processor, a Reduced Instruction Set Computing (RISC) processor, an Application-Specific Integrated Circuit (ASIC) processor, a Complex Instruction Set Computing (CISC) processor, or any other processor.

The second memory device 1204 may include suitable logic, circuitry, and/or interfaces that are adapted to store a set of instructions that is executable by the processor 1202 to perform the predetermined operation. Some of the commonly known memory implementations include, but are not limited to, a random access memory (RAM), a read only memory (ROM), a hard disk drive (HDD), and a secure digital (SD) card.

The second communication interface 1206 may correspond to a communication interface that facilitates transmission and reception of messages and data to and from various devices operating in the system environment 100 through the network 104. For example, the second communication interface 1206 is communicatively coupled with the printer apparatus 106 through the network 104. Examples of the second communication interface 1206 may include, but are not limited to, an antenna, an Ethernet port, a USB port, a serial port, or any other port that can be adapted to receive and transmit data. The second communication interface 1206 transmits and receives data and/or messages in accordance with the various communication protocols, such as, I2C, TCP/IP, UDP, and 2G, 3G, or 4G communication protocols.

The driver unit 1208 may include suitable logic and circuitry that enables the driver unit 1208 to communicate with one or more peripheral devices. For example, the driver unit 1208 may be configured to communicate with the printer apparatus 106. In an example embodiment, the driver unit 1208 may be further configured to translate the instructions received from the processor 202 to another instruction that is executable by the peripheral device. For example, the driver unit 1208 may be configured to generate the print job based on an instruction received to print the data. In an example embodiment, the printer apparatus 106 can comprehend the print job to process the print job. Further, the driver unit 1208 is configured to receive the utilization dataset pertaining to the utilization of the first set of heating elements 112 from the printer apparatus 106. Additionally, the driver unit 1208 may be configured to receive the notification from the printer apparatus 106. The operation of the driver unit 1208 has been described in conjunction with FIGS. 13, 14, and 15.

Figure 13:
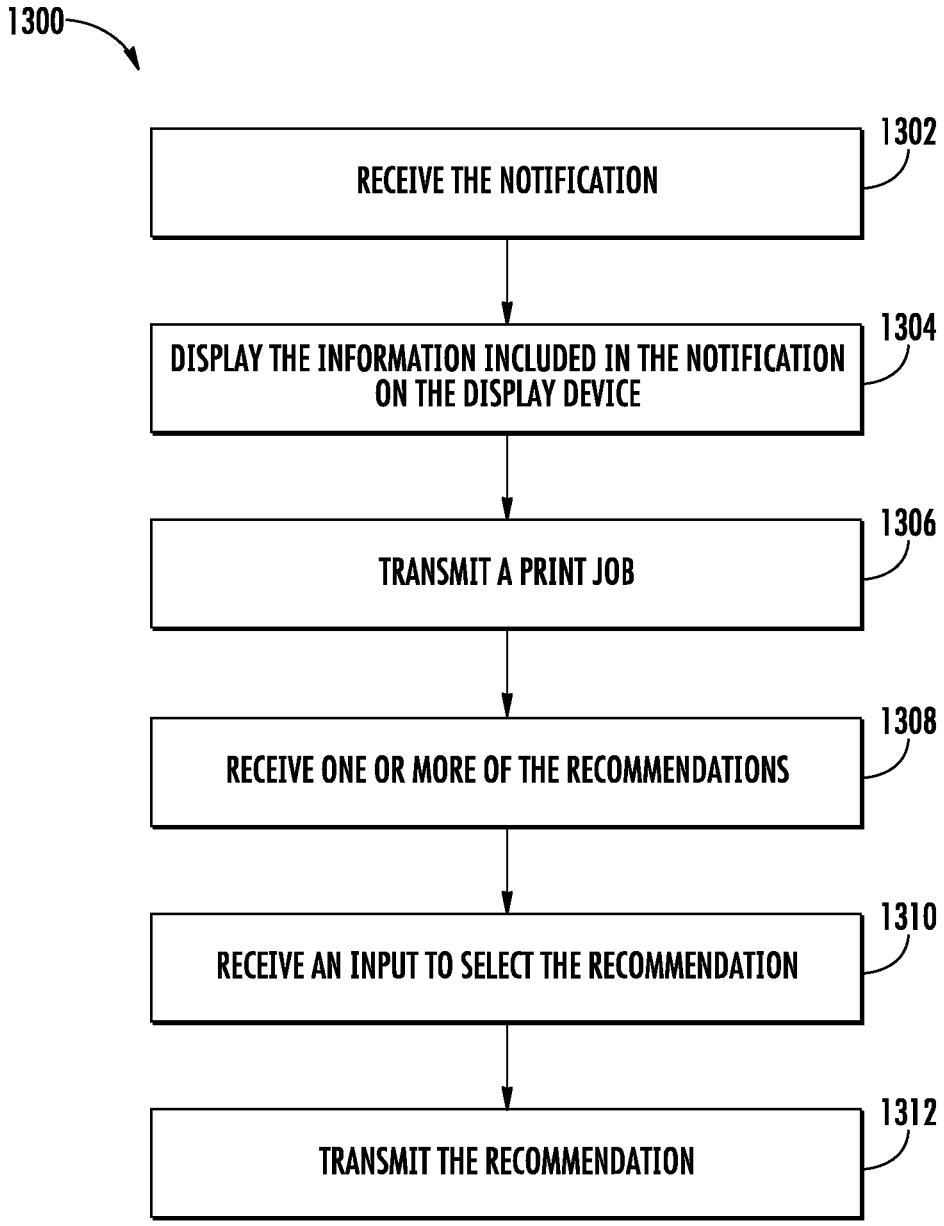
FIG. 13 illustrates a flowchart of a method for operating the printer apparatus, in accordance with one or more embodiments.
Figure 14:
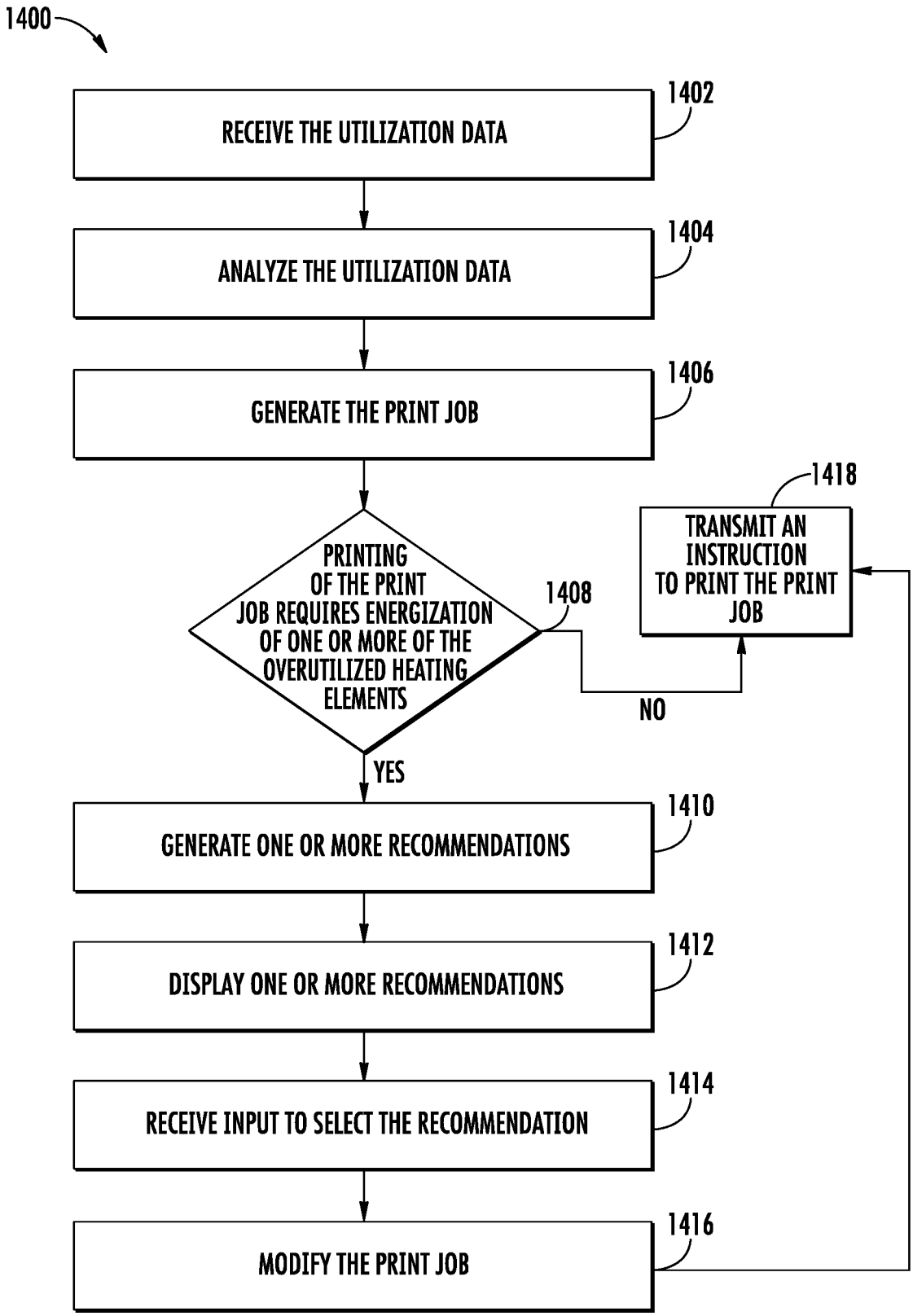
FIG. 14 illustrates a flowchart of a method for processing the print job, in accordance with one or more embodiments.
Figure 15:
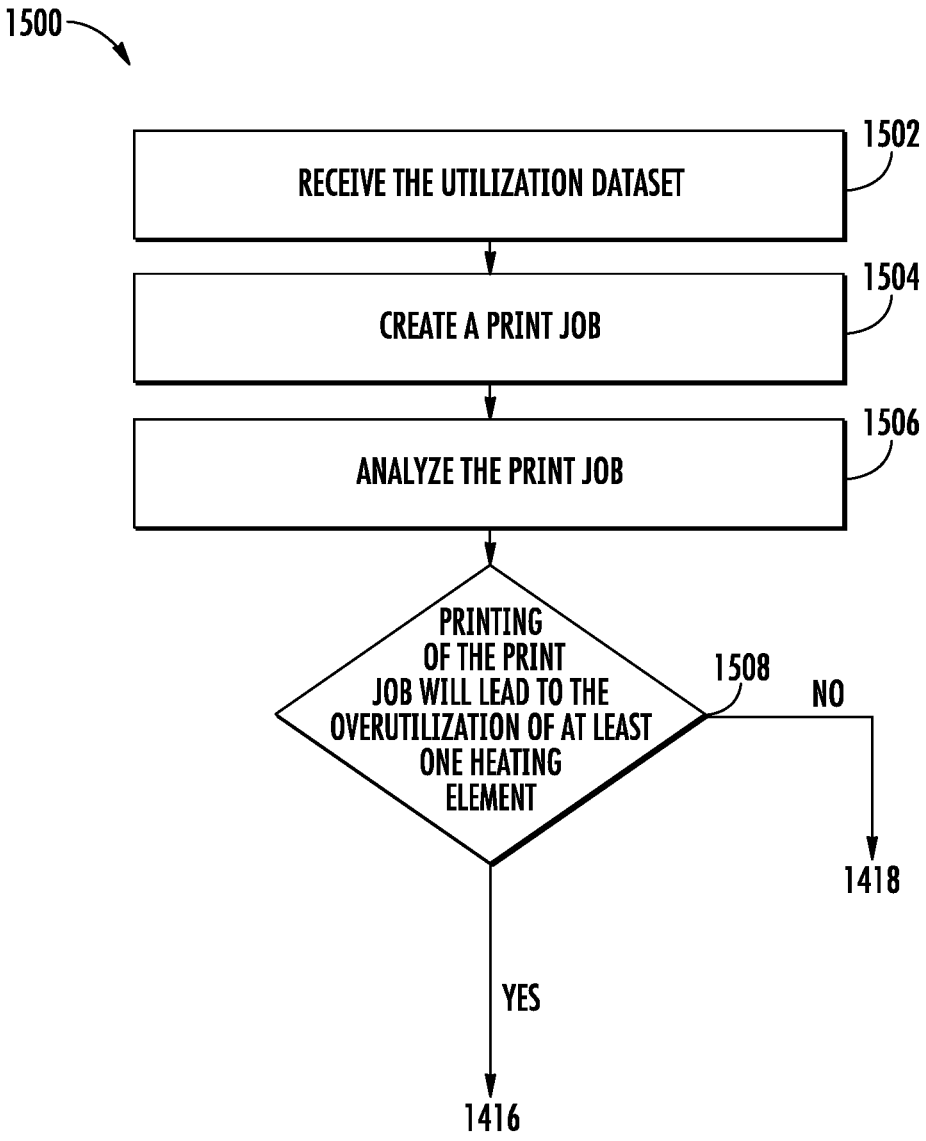
FIG. 15 illustrates another flowchart of method for processing the print job, in accordance with one or more embodiment.

FIGS. 13-15 illustrate example flowcharts of the operations performed by an apparatus, such as computing device 102 of FIG. 12 in accordance with example embodiments of the present invention. It will be understood that each block of the flowcharts, and combinations of blocks in the flowcharts, may be implemented by various means, such as hardware, firmware, one or more processors, circuitry and/or other devices associated with execution of software including one or more computer program instructions. For example, one or more of the procedures described above may be embodied by computer program instructions. In this regard, the computer program instructions which embody the procedures described above may be stored by a memory of an apparatus employing an embodiment of the present invention and executed by a processor in the apparatus. As will be appreciated, any such computer program instructions may be loaded onto a computer or other programmable apparatus (e.g., hardware) to produce a machine, such that the resulting computer or other programmable apparatus provides for implementation of the functions specified in the flowcharts' block(s). These computer program instructions may also be stored in a non-transitory computer-readable storage memory that may direct a computer or other programmable apparatus to function in a particular manner, such that the instructions stored in the computer-readable storage memory produce an article of manufacture, the execution of which implements the function specified in the flowcharts' block(s). The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowcharts' block(s). As such, the operations of FIGS. 13-15, when executed, convert a computer or processing circuitry into a particular machine configured to perform an example embodiment of the present invention. Accordingly, the operations of FIGS. 13-15 define an algorithm for configuring a computer or processor, to perform an example embodiment. In some cases, a general purpose computer may be provided with an instance of the processor which performs the algorithm of FIGS. 13-15 to transform the general purpose computer into a particular machine configured to perform an example embodiment.

Accordingly, blocks of the flowchart support combinations of means for performing the specified functions and combinations of operations for performing the specified functions. It will also be understood that one or more blocks of the flowcharts', and combinations of blocks in the flowchart, can be implemented by special purpose hardware-based computer systems which perform the specified functions, or combinations of special purpose hardware and computer instructions.

FIG. 13 illustrates a flowchart 1300 of a method for operating the printer apparatus 106, in accordance with one or more embodiments. The flowchart 1300 has been described in conjunction with FIGS. 1 through 12.

At step 1302, the computing device 102 may include means such as the driver unit 1208, for receiving the notification from the printer apparatus 106. As discussed above, the notification is indicative of the identification of the one or more overutilized heating elements. Further, as discussed, the notification may include the at least one histogram (for example, the histogram 700), and information pertaining to the life of each heating element of the first set of heating elements 112. Further, the notification may include the information pertaining to the life of the print head arrangement 108.

At step 1304, the computing device 102 may include means such as the driver unit 1208 for displaying the information included in the notification is displayed on a display device (not shown) of the computing device 102. In an example embodiment, the driver unit 1208 may be configured to display the notification on a first user interface. An exemplary first user interface has been described below in conjunction with FIG. 16.

At step 1306, the computing device 102 may include means such as the driver unit 1208 for transmitting the print job to the printer apparatus 106.

At step 1308, the computing device 102 may include means such as the driver unit 1208 for receiving the one or more print job recommendations from the printer apparatus 106. As discussed, the one or more print job recommendations correspond to possible modifications that can be made to the print job. On receiving the one or more print job recommendations, the driver unit 1208 may be configured to display the one or more print job recommendations on a second user interface on the display device. The second user interface has been described later in conjunction with FIG. 17.

At step 1310, the computing device 102 may include means such as the driver unit 1208 for receiving an input to select a recommendation from the one or more print job recommendations.

At step 1312, the computing device 102 may include means such as the driver unit 1208 for transmitting the selected recommendation to the printer apparatus 106.

A person having ordinary skills in the art would appreciate that the scope of the disclosure is not limited to receiving the one or more print job recommendations and the transmitting the selected recommendation. In an example embodiment, the computing device 102 may be configured to edit the one or more print job recommendations. In such a scenario, the computing device 102 may provide one or more tools on the second user interface to edit the one or more print job recommendations. For example, a recommendation of the one or more print job recommendations correspond to changing the size of the data in the print job. In such a scenario, driver unit 1208 may be configured to display tools on the second user interface using which the operator may provide the input to modify the size of the data. In an example embodiment, the driver unit 1208 may be further configured to display a preview of the data on the second user interface. The preview allows the operator to validate whether the recommendations, selected or modified by the operator, is in accordance with the needs of the operator.

It may be contemplated that the scope of the disclosure is not limited to the printer apparatus 106 generating the one or more print job recommendations and accordingly modifying the print job. In an example embodiment, the computing device 102 may be configured to generate the one or more print job recommendations and modify the print job. One such example method has been described in conjunction with FIG. 14.

FIG. 14 illustrates a flowchart 1400 of a method for modifying the print job, in accordance with one or more embodiments. The flowchart 1400 has been described in conjunction with FIGS. 1 through 12.

At step 1402, the computing device 102 may include means such as the driver unit 1208 for receiving the utilization dataset pertaining to the first set of heating elements 112 from the printer apparatus 106.

At step 1404, the computing device 102 may include means such as the driver unit 1208 for analyzing the utilization dataset to identify the one or more overutilized heating elements. In an example embodiment, the driver unit 1208 may be configured to analyze the utilization dataset using the methodology described in step 306 of flowchart 300. Further, the driver unit 1208 may be configured to store the one or more parameters associated with the one or more overutilized heating elements in the second memory device 1204.

At step 1406, the computing device 102 may include means such as the driver unit 1208 for generating the print job In an example embodiment, the driver unit 1208 may be configured to generate the print job based on the data (to be printed) received from the processor 202. Thereafter, the driver unit 1208 may be configured to generate the print job. As discussed, the print job includes at least the position of the data to be printed, and the data, itself.

At step 1408, the computing device 102 may include means such as the driver unit 1208 for determining whether printing of the print job requires energization of the one or more overutilized heating elements. In an example embodiment, the driver unit 1208 may be configured to perform the check using the methodology described in the step 808 of the flowchart 800. If at step 1408, it is determined by the driver unit 1208 that the printing of the print job requires the energization of the one or more overutilized heating elements, the driver unit 1208 may perform the step 1410. On the other hand, if the driver unit 1208 determines that the printing of the print job does not require the energization of the one or more overutilized heating elements, the driver unit 1208 performs the step 1418.

At step 1410, the computing device 102 may include means such as the driver unit 1208 for generating the one or more print job recommendations. In an example embodiment, the driver unit 1208 may employ similar methodologies, to generate the one or more print job recommendations, as described in the step 810.

At step 1412, the computing device 102 may include means such as the driver unit 1208 for displaying the one or more print job recommendations on the second user interface on the display device of the computing device 102.

At step 1414, the computing device 102 may include means such as the driver unit 1208 for receiving an input from the operator of the computing device 102 to select a recommendation from the one or more print job recommendations.

At step 1416, the computing device 102 may include means such as the driver unit 1208 for modifying the print job based on the selected recommendation.

At step 1418, the computing device 102 may include means such as the driver unit 1208 for transmitting an instruction to print the modified print job to the printer apparatus 106.

Additionally or alternately, the driver unit 1208 may be further configured to generate the notification based on the identification of the one or more overutilized heating elements (determined in the step 1404). In an example embodiment, the driver unit 1208 may be further configured to display the notification on the first user interface.

It may be contemplated that the scope of the disclosure is not limited to modifying the print job in response to the identification of the one or more overutilized heating elements. In an example embodiment, the print job may be modified proactively or preemptively. One such method of proactively modifying the print job has been described in conjunction with FIG. 15. For the purpose of describing FIG. 15, in some example embodiments, the one or more overutilized heating elements have not yet been identified.

FIG. 15 illustrates another flowchart 1500 of method for modifying the print job, in accordance with one or more embodiments.

At step 1502, the computing device 102 may include means such as the driver unit 1208 for receiving the utilization dataset pertaining to the first set of heating elements. As discussed, the utilization dataset includes the one or more parameters associated with the first set of heating elements 112.

At step 1504, the computing device 102 may include means such as the driver unit 1208 for creating the print job based on the data to be printed (received from the processor 1202).

At step 1506, the computing device 102 may include means such as the driver unit 1208 for analyzing the print job to identify the original set of heating elements that will be energized to print the print job. In an example embodiment, as discussed above in the step 808, the analysis of the print job includes determining the position of the data define the print job. Further, based on the position of the data, the driver unit 1208 may determine the original set of heating elements that will be energized to print the print job. Further, the driver unit 1208 may analyze the print job to determine a third energization count for which each heating element of the first set of heating elements 112 will be energized to print the print job. Furthermore, the driver unit 1208 may analyze the print job to determine a third energization duration for which each heating element will be energized to print the print job.

At step 1508, the computing device 102 may include means such as the driver unit 1208 for determining whether, during the printing of the print job, at least one heating element in the original set of heating elements will get overutilized.

In an example embodiment, the driver unit 1208 may retrieve the cumulative energization count and the cumulative energization duration, associated with each heating element in the original set of heating elements. Thereafter, driver unit 1208 may be configured to add the third energization count and the third energization duration to the cumulative energization count and cumulative energization duration, respectively, for each heating element in the original set of heating elements. Thereafter, the updated cumulative energization count and the updated cumulative energization duration are compared with the predetermined threshold energization count and the predetermined threshold energization duration, respectively, to determine whether at least one heating element in the original set of heating elements will get overutilized during printing of the print job.

For example, the cumulative energization count and the cumulative energization duration associated with a heating element in the original set of heating elements is "15" and "10" seconds, respectively. Further, the driver unit 1208 determines that during the printing of the print job, the heating element will get energized "5" times for a period of "2" seconds. Thereafter, the driver unit 1208 may be configured to determine updated cumulative energization count and the updated cumulative energization duration as "20" and "17" seconds, respectively.

Subsequently, the driver unit 1208 may be configured to check whether the updated cumulative energization count (determined as "20") and the updated energization duration (determined as 17 seconds) exceed the respective threshold values (i.e., predetermined threshold energization count and the predetermined threshold energization duration). For instance, if the predetermined threshold energization count is "17" and predetermined threshold energization duration is "15" seconds, the driver unit 1208 determines that the heating element will get overutilized during the printing of the print job. While described above with reference to units of seconds, as would be understood by one of ordinary skill in the art, energization duration may in operation be in units on the order of microseconds. For example, a heating element may be energized in some embodiments for a period between 50 microseconds and 400 microseconds.

If the driver unit 1208 determines that the at least one heating element will get overutilized during printing of the print job, the driver unit 1208 may perform the step 1416 (described in flowchart 1400). However, if the driver unit 1208 determines that none of the heating elements will get overutilized during printing of the print job, the driver unit 1208 performs the step 1418 to transmit the instruction to print the print job without modification.

The method described in the flowchart 1500 facilitates preemptive identification of the heating elements that might get overutilized during printing of the print job. Further modifying the print job on identification of such heating elements (that might get overutilized in the future) minimizes the utilization of such heating elements.

Figure 16:
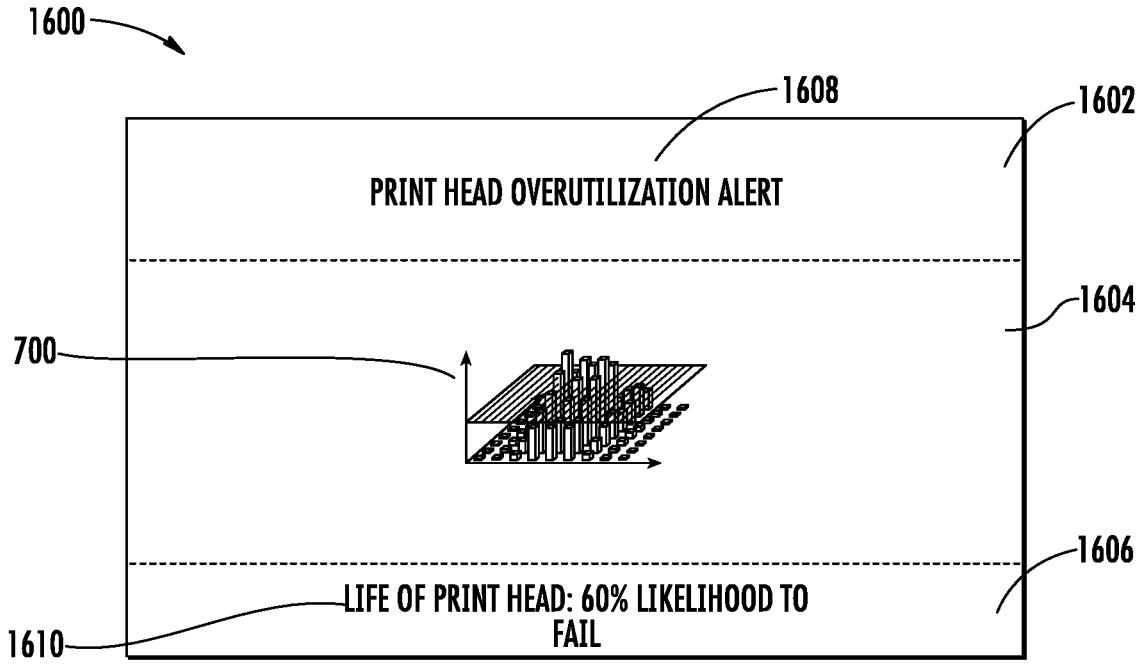
FIG. 16 illustrates an exemplary first user interface, in accordance with one or more embodiments.

FIG. 16 illustrates an exemplary first user interface 1600, in accordance with one or more embodiments. The first user interface 1600 has been described in conjunction with FIGS. 13, 14, and 15.

The first user interface 1600 includes a first portion 1602, a second portion 1604, and a third portion 1606. The first portion 1602 is adapted to display an alert message that is indicative of a warning. For instance, the first portion 1602 is utilized to display the alert message "print head arrangement overutilization alert" (depicted by 1608). The second portion 1604 may be adapted to display the histogram (included in the notification). For instance, the second portion 1604 may be adapted to display the histogram 700. Further, the third portion 1606 may be configured to display information pertaining to the life of the print head arrangement 108. As discussed above, the life of the print head arrangement may correspond to the likelihood of the print head arrangement 108 to fail. For instance, the third portion 1606 displays a message "60% likelihood of the print head arrangement to fail" (depicted by 1610).

Figure 17:
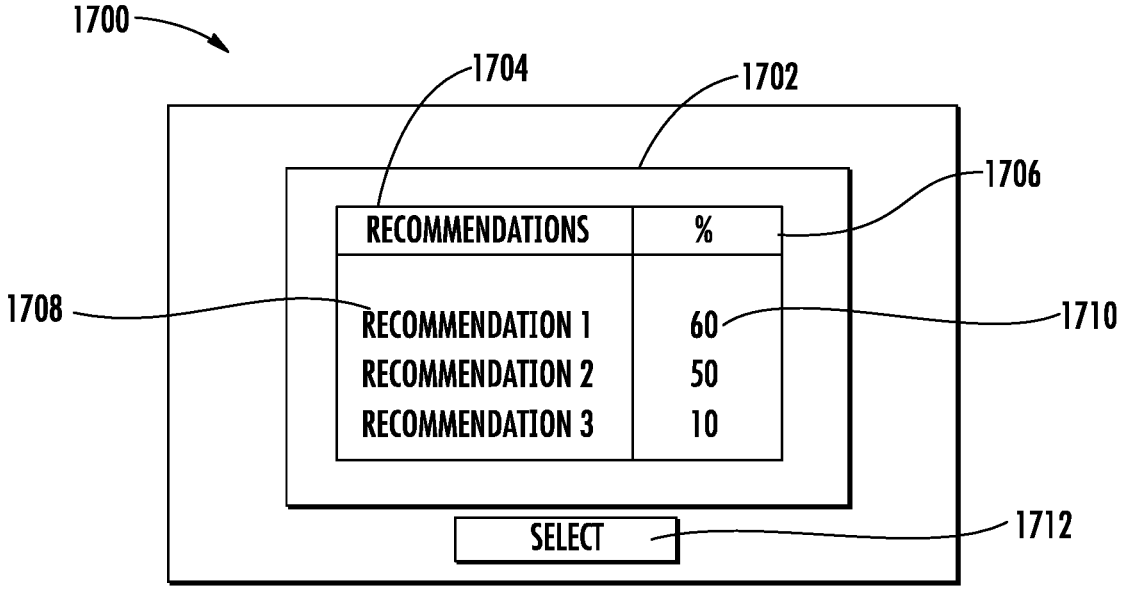
FIG. 17 illustrates an exemplary second user interface, in accordance with one or more embodiments.

FIG. 17 illustrates an exemplary second user interface 1700, in accordance with one or more embodiments. As discussed, the second user interface 1700 may be configured to display the one or more print job recommendations to the operator on the display device of the computing device 102.

The second user interface 1700 includes a list section 1702 that is configured to display the list of the one or more print job recommendations received from the printer apparatus 106. For instance, the list section 1702 displays the one or more print job recommendations in a tabular form, wherein the first column (depicted by 1704) illustrates the name of the recommendation and the second column (depicted by 1706) illustrates the percentage of the overutilized heating elements in the different set of heating elements associated with respective recommendations. For instance, the list section 1702 display that the recommendation-1 (depicted by 1708) has 60% overutilized heating elements (depicted by 1710) in the different set of heating elements associated with the recommendation-1 (depicted by 1708).

In an example embodiment, the one or more print job recommendations listed in the list section 1702 are selectable. The operator may provide an input to select the recommendation from the one or more print job recommendations (listed in the list section 1702).

Further, the second user interface 1700 includes a select button 1712. When an input is provided to push the select button 1712, the selected recommendation is transmitted by the computing device 102 to the printer apparatus 106.

It may be contemplated that the first user interface 1600 and the second user interface 1700 are illustrations and the scope of the disclosure should not be limited to the designs of the user interfaces illustrated in FIG. 16 and FIG. 17. A person having ordinary skills in the art would appreciate that the first user interface 1600 and the second user interface 1700 may have any other design, without departing from the scope of the disclosure.

The disclosed embodiments encompass numerous advantages. The aforementioned embodiments disclose generation and display of the notification pertaining to the identification of the one or more overutilized heating elements. Such notification enables the operator of the printer apparatus 106 to timely change the print head arrangement 108 for seamless operation of the printer apparatus 106. Further, as discussed supra, the print job is being modified in such a manner that the utilization of the one or more overutilized heating elements is reduced, therefore, extending the life of the print head arrangement.

FIGS. 3-8 and 13-15 illustrate example flowcharts describing operations performed in accordance with example embodiments of the present invention. It will be understood that each block of the flowcharts, and combinations of blocks in the flowcharts, may be implemented by various means, such as hardware, firmware, one or more processors, circuitry and/or other devices associated with execution of software including one or more computer program instructions. For example, one or more of the procedures described above may be embodied by computer program instructions residing on a non-transitory computer-readable storage memory. In this regard, the computer program instructions which embody the procedures described above may be stored by a memory of an apparatus employing an embodiment of the present invention and executed by a processor of the apparatus. As will be appreciated, any such computer program instructions may be loaded onto a computer or other programmable apparatus (e.g., hardware) to produce a machine, such that the resulting computer or other programmable apparatus provides for implementation of the functions specified in the flowchart blocks. When executed, the instructions stored in the computer-readable storage memory produce an article of manufacture configured to implement the various functions specified in flowchart blocks. Moreover, execution of a computer other processing circuitry to perform various functions converts the computer or other processing circuitry into a particular machine configured to perform an example embodiment of the present invention. Accordingly, the operations set forth in the flowcharts define one or more algorithms for configuring a computer or processor, to perform an example embodiment. In some cases, a general purpose computer may be provided with an instance of the processor which performs algorithms described in one or more flowcharts to transform the general purpose computer into a particular machine configured to perform an example embodiment.

Accordingly, the described flowchart blocks support combinations of means for performing the specified functions and combinations of operations for performing the specified functions. It will also be understood that one or more flowchart blocks, and combinations of flowchart blocks, can be implemented by special purpose hardware-based computer systems which perform the specified functions, or combinations of special purpose hardware that execute computer instructions.

In some example embodiments, certain ones of the operations herein may be modified or further amplified as described below. Moreover, in some embodiments additional optional operations may also be included. It should be appreciated that each of the modifications, optional additions or amplifications described herein may be included with the operations herein either alone or in combination with any others among the features described herein.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The hardware used to implement the various illustrative logics, logical blocks, modules, and circuits described in connection with the aspects disclosed herein may include a general purpose processor, a digital signal processor (DSP), a special-purpose processor such as an application specific integrated circuit (ASIC) or a field programmable gate array (FPGA), a programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Alternatively or in addition, some steps or methods may be performed by circuitry that is specific to a given function.

In one or more example embodiments, the functions described herein may be implemented by special-purpose hardware or a combination of hardware programmed by firmware or other software. In implementations relying on firmware or other software, the functions may be performed as a result of execution of one or more instructions stored on one or more non-transitory computer-readable media and/or one or more non-transitory processor-readable media. These instructions may be embodied by one or more processor-executable software modules that reside on the one or more non-transitory computer-readable or processor-readable storage media. Non-transitory computer-readable or processor-readable storage media may in this regard comprise any storage media that may be accessed by a computer or a processor. By way of example but not limitation, such non-transitory computer-readable or processor-readable media may include RAM, ROM, EEPROM, FLASH memory, disk storage, magnetic storage devices, or the like. Disk storage, as used herein, includes compact disc (CD), laser disc, optical disc, digital versatile disc (DVD), floppy disk, and Blu-ray Disc™, or other storage devices that store data magnetically or optically with lasers. Combinations of the above types of media are also included within the scope of the terms non-transitory computer-readable and processor-readable media. Additionally, any combination of instructions stored on the one or more non-transitory processor-readable or computer-readable media may be referred to herein as a computer program product.

Many modifications and other embodiments of the inventions set forth herein will come to mind to one skilled in the art to which these inventions pertain having the benefit of teachings presented in the foregoing descriptions and the associated drawings. Although the figures only show certain components of the apparatus and systems described herein, it is understood that various other components may be used in conjunction with the supply management system. Therefore, it is to be understood that the inventions are not to be limited to the specific embodiments disclosed and that modifications and other embodiments are intended to be included within the scope of the appended claims. Moreover, the steps in the method described above may not necessarily occur in the order depicted in the accompanying diagrams, and in some cases one or more of the steps depicted may occur substantially simultaneously, or additional steps may be involved. Although specific terms are employed herein, they are used in a generic and descriptive sense only and not for purposes of limitation.

What is claimed is:

1. A printer apparatus comprising:

a print head arrangement comprising a first set of heating elements; and a controller coupled to the print head arrangement, wherein the controller is configured to:

monitor a parameter of each heating element in the first set of heating elements;

analyze a utilization dataset generated based on the monitored parameter to identify one or more overutilized heating elements of the first set of heating elements; and modify data included in a print job to cause a decrease in utilization of the identified one or more overutilized heating elements.

2. The printer apparatus according to claim 1, further comprising a display screen configured to display a notification, wherein the notification comprises at least a histogram illustrating the utilization dataset.

3. The printer apparatus according to claim 1, wherein the controller is configured to monitor the parameter of each heating element of the first set of heating elements to determine an energization count for each heating element, wherein the energization count comprises a number of times each heating element is energized during printing of one or more print jobs.

4. The printer apparatus according to claim 3, wherein the controller is further configured to analyze the utilization dataset by comparing the energization count of each heating element in the first set of heating elements with a predetermined threshold energization count.

5. The printer apparatus according to claim 1, wherein the controller is configured to monitor the parameter of each heating element of the first set of heating elements to determine an energization duration of each heating element, wherein the energization duration comprises a time period each heating element is energized during printing of one or more print jobs.

6. The printer apparatus according to claim 5, wherein the controller is configured to analyze the utilization dataset by comparing the energization duration of each heating element of the first set of heating elements with a predetermined threshold energization duration.

7. The printer apparatus according to claim 1, wherein the controller is configured to analyze the utilization dataset by determining a likelihood to fail for each heating element of the first set of heating elements based on an energization count and an energization duration, associated with each heating element in the first set of heating elements.

8. The printer apparatus of claim 7, wherein the controller is further configured to:

determine a first difference between the energization count associated with each heating element in the first set of heating elements and a maximum energization count;

determine a second difference between the energization duration associated with each heating element in the first set of heating elements and a maximum energization duration; and determine the likelihood to fail for each heating element based on the first difference and the second difference.

9. The printer apparatus according to claim 7, wherein the controller is configured to compare the likelihood to fail for each heating element of the first set of heating elements with a predetermined failure threshold, to identify the one or more overutilized heating elements.

10. The printer apparatus according to claim 1, wherein the controller is configured to modify the data in the print job to modify one or more of a size of the data in the print job, a position of the data in the print job, or a font type of the data in the print job, wherein printing the modified data in the print job includes utilizes a second set of heating elements, and wherein the second set of heating elements comprises a portion of the first set of heating elements exclusive of the one or more overutilized heating elements.

11. The printer apparatus according to claim 1, wherein the controller is configured to modify the data in the print job such that printing the modified data utilizes one or more heating elements of a second set of heating elements and one or more heating elements of the one or more overutilized heating elements, wherein the second set of heating elements comprises a portion of the first set of heating elements exclusive of the one or more overutilized heating elements.

12. The printer apparatus according to claim 1, wherein the controller is configured to determine a remaining life for each heating element of the first set of heating elements based on at least one of an energization count or an energization duration of the heating element.

13. The printer apparatus according to claim 1, wherein the controller is configured to generate a notification identifying the remaining life for one or more of the heating elements.

14. The printer apparatus according to claim 1, wherein the controller is further configured to generate one or more print job recommendations for display to a user, wherein a print job recommendation of the one or more print job recommendations comprises the print job that includes modified data, and wherein printing the modified data utilizes a second set of heating elements, wherein the second set of heating elements comprises a portion of the first set of heating elements exclusive of the one or more overutilized heating elements.

15. The printer apparatus of claim 1, wherein the controller is further configured to analyze the data in the print job to determine whether printing the data in the print job will utilize at least one heating element of the one or more identified overutilized elements.

16. The printer apparatus of claim 5, wherein the controller is further configured to modify the data in the print job in response to determining that printing the data in the print job will utilize at least one heating element.

17. A method for operating a printer apparatus, the method comprising:

monitoring, by a controller, a parameter of each heating element in the first set of heating elements;

analyzing, by the controller, a utilization dataset generated based on the monitored parameter to identify one or more overutilized heating elements of the first set of heating elements; and modifying, by the controller, data included in a print job to cause a decrease in utilization of the identified one or more overutilized heating elements.

18. The method according to claim 17, further comprising modifying the data in the print job to modify one or more of a size of the data in the print job, a position of the data in the print job, or a font type of the data in the print job, wherein printing the modified data in the print job includes utilizes a second set of heating elements, and wherein the second set of heating elements comprises a portion of the first set of heating elements exclusive of the one or more overutilized heating elements.

19. The method according to claim 17, further comprising modifying the data in the print job such that printing the modified data utilizes one or more heating elements of a second set of heating elements and one or more heating elements of the one or more overutilized heating elements, wherein the second set of heating elements comprises a portion of the first set of heating elements exclusive of the one or more overutilized heating elements.

20. A computer program product comprising at least one non-transitory computer readable storage medium having computer-executable program code instruction stored therein, the computer-executable program code instructions comprising program code instructions for:

monitoring a parameter of each heating element in the first set of heating elements;

analyzing a utilization dataset generated based on the monitored parameter to identify one or more overutilized heating elements of the first set of heating element; and modifying data included in a print job to cause a decrease in utilization of the identified one or more overutilized heating elements.

* * * * *